US007787004B2

(12) United States Patent
Nomura et al.

(10) Patent No.: US 7,787,004 B2
(45) Date of Patent: Aug. 31, 2010

(54) LINE HEAD AND IMAGE FORMING APPARATUS USING THE SAME

(75) Inventors: Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/356,392

(22) Filed: Jan. 20, 2009

(65) Prior Publication Data

US 2009/0185829 A1 Jul. 23, 2009

(30) Foreign Application Priority Data

Jan. 21, 2008 (JP) ..... 2008-010106
Dec. 12, 2008 (JP) ..... 2008-316536

(51) Int. Cl.
*B41J 2/45* (2006.01)

(52) U.S. Cl. ..... 347/238

(58) Field of Classification Search ..... 347/230, 347/238, 241, 242, 244, 245, 256–258
See application file for complete search history.

(56) References Cited

U.S. PATENT DOCUMENTS 4,715,682 A * 12/1987 Koek et al. ..... 359/820
4,958,912 A * 9/1990 Inaba et al. ..... 349/2
6,831,673 B2 * 12/2004 Wakisaka et al. ..... 347/238

FOREIGN PATENT DOCUMENTS

JP 06-270468 9/1994

* cited by examiner

*Primary Examiner*—Hai C Pham
(74) *Attorney, Agent, or Firm*—Hogan Lovells US LLP

(57) ABSTRACT

A line head includes: a first substrate that includes light-emitting elements formed thereon; and a second substrate that includes focusing lenses, which are inverted optical systems, focusing light emitted from the light-emitting elements, and has a linear expansion coefficient that is smaller than that of the first substrate.

10 Claims, 18 Drawing Sheets

LINE HEAD AND IMAGE FORMING APPARATUS USING THE SAME

CROSS REFERENCE TO RELATED ART

The disclosure of Japanese Patent Applications No. 2008-010106 filed on Jan. 21, 2008 and No. 2008-316536 filed on Dec. 12, 2008 including specification, drawings and claims is incorporated herein by reference in its entirety.

BACKGROUND

1. Technical Field

The present invention relates to a line head that scans a surface, such as a surface to be scanned, of a latent image carrier with light and an image forming apparatus using the same.

2. Related Art

A line head that scans a surface to be scanned of a photoconductor, which is a latent image carrier, with light to form a latent image has been used as a light source of an electrophotographic printer, which is an image forming apparatus.

An optical printer head, serving as a line head, includes a base plate, which is a substrate having light emitting diodes, serving as light-emitting elements, formed thereon, and a lens plate, which is a lens substrate that supports lenses. A lens array including lenses corresponding to the light emitting diodes is provided on the lens plate. When the base plate and the lens plate have different linear expansion coefficients and are heated, a positional deviation between the light emitting diode and the corresponding lens occurs, which makes it difficult to form a clear and exact latent image on a surface to be scanned of a photoconductor. Therefore, a structure in which the base plate and the lens plate have substantially the same linear expansion coefficient has been proposed (for example, see JP-A-6-270468 (page 3 and FIG. 1)

When the head substrate and the lens substrate have the same linear expansion coefficient, the positional relationship between the lens and the light-emitting element does not vary even though heat is applied. However, in this case, the focal position of light emitted from the light-emitting element on the surface to be scanned of the photoconductor is moved a distance corresponding to the amount of thermal expansion. When the line head is applied as an exposure unit to a tandem color image forming apparatus, the movement of the focal position causes a color registration error, and image quality deteriorates.

SUMMARY

An advantage of some aspects of the invention is that provides a line head capable of reducing the movement of the focal position of a light-emitting element on a surface to be scanned of a photoconductor due to thermal expansion, reducing a color registration error, and preventing deterioration of image quality, and an image forming apparatus using the same.

A first aspect of the invention is directed to a line head including: a first substrate that includes light-emitting elements formed thereon; and a second substrate that includes focusing lenses, which are inverted optical systems, focusing light emitted from the light-emitting elements and has a linear expansion coefficient that is smaller than that of the first substrate.

When heat is applied to the line head, the first substrate and the second substrate are expanded. However, since the linear expansion coefficient of the second substrate is smaller than that of the first substrate, a positional deviation between the light-emitting element and the focusing lens occurs, and the focal position of light emitted from the light-emitting element is also changed due to the expansion of the focusing lens. However, according to the above-mentioned aspect, since the focusing lens is an inverted optical system, the focal position of light emitted from the light-emitting element is moved in a direction that is opposite to the movement direction of the focusing lens due to thermal expansion, and the positional deviation between the original focal position and the focal position after thermal expansion is reduced. Therefore, it is possible to obtain a line head in which the movement of a focal position due to thermal expansion is small.

A second aspect of the invention is directed to the above-mentioned line head, wherein the first substrate and the second substrate are fixed so as to be expanded or contracted in a first direction that is orthogonal to the optical axis direction of the focusing lens according to the temperature. According to this aspect, since the first substrate and the second substrate are fixed, the first and second substrates are expanded from the fixed portions. Therefore, the expansion of the substrates is fixed by the fixed portions, and it is possible to accurately control the movement of the focal position due to thermal expansion.

A third aspect of the invention is directed to the above-mentioned line head, wherein the first substrate and the second substrate are arranged such that one end of the first substrate in the first direction and one end of the second substrate in the first direction are fixed and the other ends of the first and second substrates in the first direction are expanded or contracted in the first direction according to the temperature. According to this aspect, since one end of the first substrate in the first direction and one end of the second substrate in the first direction are fixed, the positional deviation between the other ends of the first and second substrates due to thermal expansion is increased. However, since the linear expansion coefficient of the second substrate is smaller than that of the first substrate, it is possible to effectively obtain a line head in which the movement of a focal position due to thermal expansion is small.

A fourth aspect of the invention is directed to the above-mentioned line head, wherein the first substrate and the second substrate are arranged such that the center of the first substrate in the first direction and the center of the second substrate in the first direction are fixed and both ends of the first substrate in the first direction and both ends of the second substrate in the first direction are expanded or contracted in the first direction according to the temperature. According to this aspect, since the centers of the first and second substrates in the first direction are fixed, it is possible to reduce the positional deviation between the first substrate and the second substrate at both ends due to thermal expansion. As a result, it is possible to obtain a line head in which the movement of a focal position due to thermal expansion is small.

A fifth aspect of the invention is directed to the above-mentioned line head further including a case that accommodates the first substrate and the second substrate. Preferably, the first substrate and the second substrate are fixed to the case, and the other end of the first substrate and the other end of the second substrate are supported by the case so as to be movable in the first direction. According to this aspect, since the first substrate and the second substrate are positioned by the case, the positional deviation between the line head and the first and second substrates is reduced. As a result, it is possible to obtain a line head in which the movement of a focal position due to thermal expansion is small.

A sixth aspect of the invention is directed to the above-mentioned line head, wherein the other end of the first substrate and the other end of the second substrate are supported by the case with elastic members interposed therebetween. According to this aspect, since the other ends of the first and second substrates are supported by the elastic members, the thermal expansion of the first substrate and the second substrate is prevented, and the distortion of the first substrate and the second substrate is reduced. Therefore, it is possible to obtain a line head in which the movement of a focal position is small.

A seventh aspect of the invention is directed to the above-mentioned line head, wherein the linear expansion coefficient $\alpha L$ of the second substrate and the linear expansion coefficient $\alpha E$ of the first substrate satisfy the following expression:

$$\alpha L+m(\alpha E-\alpha L)=0$$

(where m indicates the optical magnification of the focusing lens). According to this aspect, when the linear expansion coefficient $\alpha L$ of the second substrate and the linear expansion coefficient $\alpha E$ of the first substrate satisfy the above-mentioned expression, the movement distance of the focusing lens is equal to the movement distance of the focal position relative to the focusing lens, and there is no positional deviation of the focal position after thermal expansion. Therefore, it is possible to obtain a line head in which the movement of a focal position is small.

An eighth aspect of the invention is directed to the above-mentioned line head, wherein a light-emitting element group including a plurality of light-emitting elements is formed on the first substrate, and the focusing lens focuses light emitted from the plurality of light-emitting elements of the light-emitting element group. According to this aspect, light emitted from a plurality of light-emitting elements is focused on a predetermined surface by one focusing lens. Therefore, it is possible to form a high-density image with a small amount of positional deviation using a simple structure.

A ninth aspect of the invention is directed to the above-mentioned line head, wherein a plurality of light-emitting element groups are arranged on the first substrate. According to this aspect, since light is focused by each light-emitting element group and the focusing lens corresponding thereto, it is possible to form a high-density image with a small amount of positional deviation.

A tenth aspect of the invention is directed to the above-mentioned line head, wherein the plurality of light-emitting element groups are two-dimensionally arranged on the first substrate. According to this aspect, the two-dimensional arrangement structure can increase the density of an image.

An eleventh aspect of the invention is directed to an image forming apparatus including: a latent image carrier on which a latent image is formed; an exposure unit that includes a first substrate having light-emitting elements formed thereon and a second substrate including focusing lenses, which are inverted optical systems, focusing light emitted from the light-emitting elements on the latent image carrier and having a linear expansion coefficient that is smaller than that of the first substrate, and forms the latent image on the latent image carrier; and a developing unit that develops the latent image formed on the latent image carrier. According to this aspect, it is possible to obtain an image forming apparatus having the above-mentioned effects.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, exemplary embodiments of the invention will be described with reference to the accompanying drawings.

First Embodiment

Figure 1:
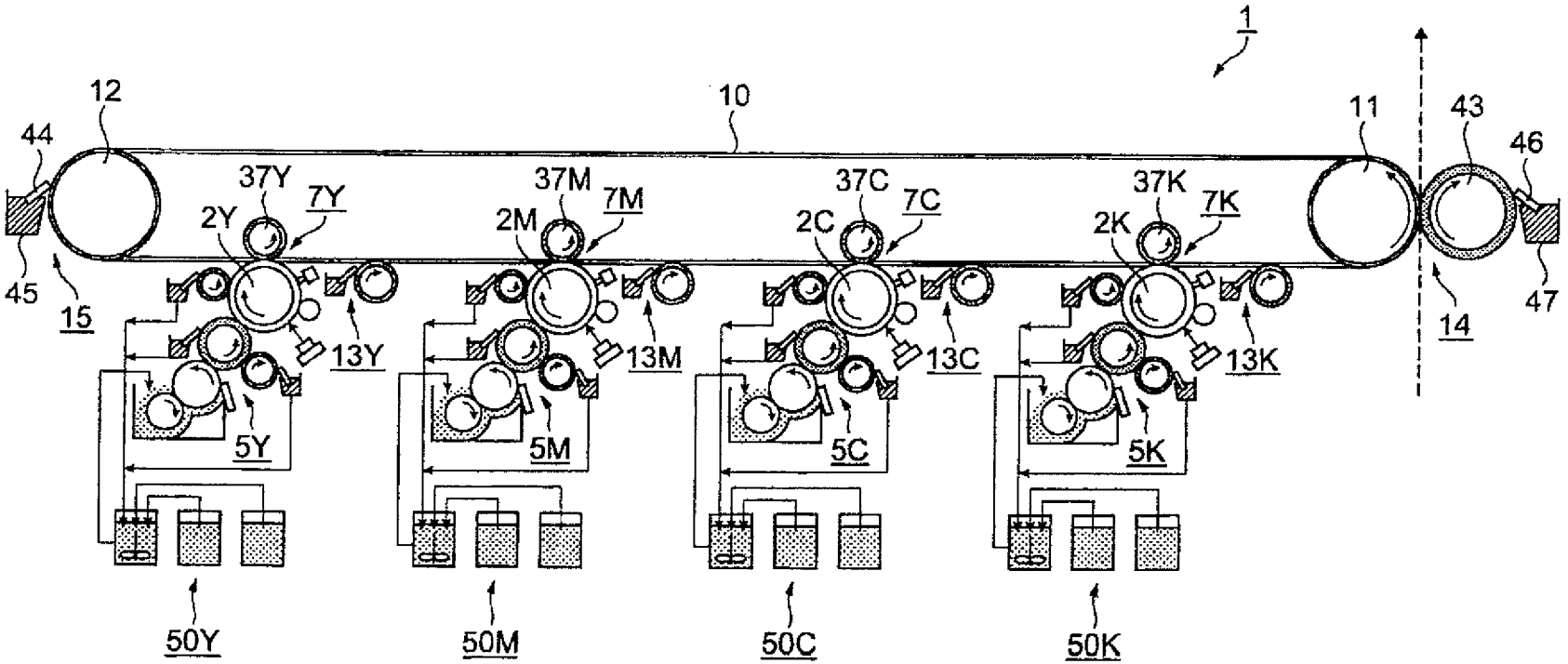
FIG. 1 is a partial diagram schematically illustrating an image forming apparatus according to a first embodiment of the invention.

FIG. 1 is a partial diagram schematically illustrating an image forming apparatus 1 according to a first embodiment of the invention. The image forming apparatus 1 forms an image using a liquid developer including toner particles dispersed in a liquid carrier. In addition, the rotational direction of a rotating member is represented by a solid arrow.

In FIG. 1, the image forming apparatus 1 includes an endless intermediate transfer belt 10, which is an intermediate transfer medium, a driving roller 11 and a driven roller 12 that support the intermediate transfer belt 10, a secondary transfer device 14, an intermediate transfer belt cleaning device 15, and primary transfer units. The secondary transfer device 14 is provided on one side of the intermediate transfer belt 10 close to the driving roller 11, and the intermediate transfer belt cleaning device 15 is provided on the other side of the intermediate transfer belt 10 close to the driven roller 12. The primary transfer units include a primary transfer unit 50Y, a primary transfer unit 50M, a primary transfer unit 50C, and a primary transfer unit 50K respectively corresponding to yellow (Y), magenta (M), cyan (C), and black (K). In the following description, letters Y, M, C, and K are also added to devices and members corresponding to the above-mentioned colors.

Although not shown in the drawings, similar to a general image forming apparatus according to the related art that performs a secondary transfer process, the image forming apparatus 1 includes, for example, a transfer material accommodating device that accommodates a transfer material, such as a sheet, and a pair of rollers that transports the transfer material from the transfer material accommodating device to the secondary transfer device 14, on the upstream side of the secondary transfer device 14 in the direction in which the transfer material is transported. In FIG. 1, the transport direction of the transfer material is represented by a dashed arrow. In addition, the image forming apparatus 1 includes a fixing device and a sheet discharge tray on the downstream side of the secondary transfer device 14 in the direction in which the transfer material is transported.

In FIG. 1, the intermediate transfer belt 10 is supported by a pair of the driving roller 11 and the driven roller 12 that are separated from each other, and can be rotated in the counterclockwise direction. It is preferable that the intermediate transfer belt 10 be an elastic intermediate transfer belt in order to improve the secondary transfer efficiency of a transfer material, such as a sheet. In this embodiment, in the image forming apparatus 1, the primary transfer units 50Y, 50M, 50C, and 50K are arranged in the order of Y, M, C, and K on the upstream side of the intermediate transfer belt 10 in the rotational direction, but the arrangement of Y, M, C, and K may be arbitrarily set. Instead of the intermediate transfer belt 10, an intermediate transfer drum may be used as the intermediate transfer medium.

The secondary transfer device 14 includes a secondary transfer roller 43. The secondary transfer roller 43 is used to bring a transfer material, such as a sheet, into contact with the intermediate transfer belt 10 wound around the driving roller 11 and transfer a color toner image (color image) obtained by superimposing toner images having the above-mentioned colors on the intermediate transfer belt 10 onto the transfer material. In this case, the driving roller 11 also serves as a backup roller during a secondary transfer operation. In addition, the secondary transfer device 14 includes a secondary transfer roller cleaner 46 and a secondary transfer roller cleaner liquid collection container 47. The secondary transfer roller cleaner 46 is formed of an elastic material, such as rubber. The secondary transfer roller cleaner 46 comes into contact with the secondary transfer roller 43, and scrapes and removes the liquid developer remaining on the surface of the secondary transfer roller 43 after the secondary transfer operation. In addition, the secondary transfer roller cleaner liquid collection container 47 collects and stores the liquid developer removed from the secondary transfer roller 43 by the secondary transfer roller cleaner 46.

The intermediate transfer belt cleaning device 15 includes an intermediate transfer belt cleaner 44 and an intermediate transfer belt cleaner liquid collection container 45. The intermediate transfer belt cleaner 44 comes into contact with the intermediate transfer belt 10 and scrapes and removes the liquid developer remaining on the surface of the intermediate transfer belt 10 after the secondary transfer operation. In this case, the driven roller 12 also serves as a backup roller during an intermediate transfer belt cleaning operation. The intermediate transfer belt cleaner 44 is formed of an elastic material, such as rubber. The intermediate transfer belt cleaner liquid collection container 45 collects and stores the liquid developer removed from the intermediate transfer belt 10 by the intermediate transfer belt cleaner 44.

The primary transfer units 50Y, 50M, 50C, and 50K include developing devices 5Y, 5M, 5C, and 5K, primary transfer devices 7Y, 7M, 7C, and 7K, and photoconductors 2Y, 2M, 2C, and 2K, which are latent image carriers arranged in series to each other, respectively. In addition, intermediate transfer belt squeezing devices 13Y, 13M, 13C, and 13K are provided in the vicinities of the primary transfer devices 7Y, 7M, 7C, and 7K on the downstream sides of the primary transfer devices 7Y, 7M, 7C, and 7K in the direction in which the intermediate transfer belt 10 is rotated, respectively.

In FIG. 1, each of the photoconductors 2Y, 2M, 2C, and 2K is composed of a photoconductor drum. All the photoconductors 2Y, 2M, 2C, and 2K are rotated in the clockwise direction during an operation, as represented by solid arrows in FIG. 1. Each of the photoconductors 2Y, 2M, 2C, and 2K may be formed in an endless belt shape. The primary transfer devices 7Y, 7M, 7C, and 7K include primary transfer backup rollers 37Y, 37M, 37C, and 37K that bring the intermediate transfer belt 10 into contact with the photoconductors 2Y, 2M, 2C, and 2K, respectively.

Next, among the primary transfer units 50Y, 50M, 50C, and 50K, the primary transfer unit 50Y will be described as an example. The structure and arrangement of components of the primary transfer units 50M, 50C, and 50K are similar to those of the primary transfer unit 50Y except for the colors M, C, and K.

Figure 2:
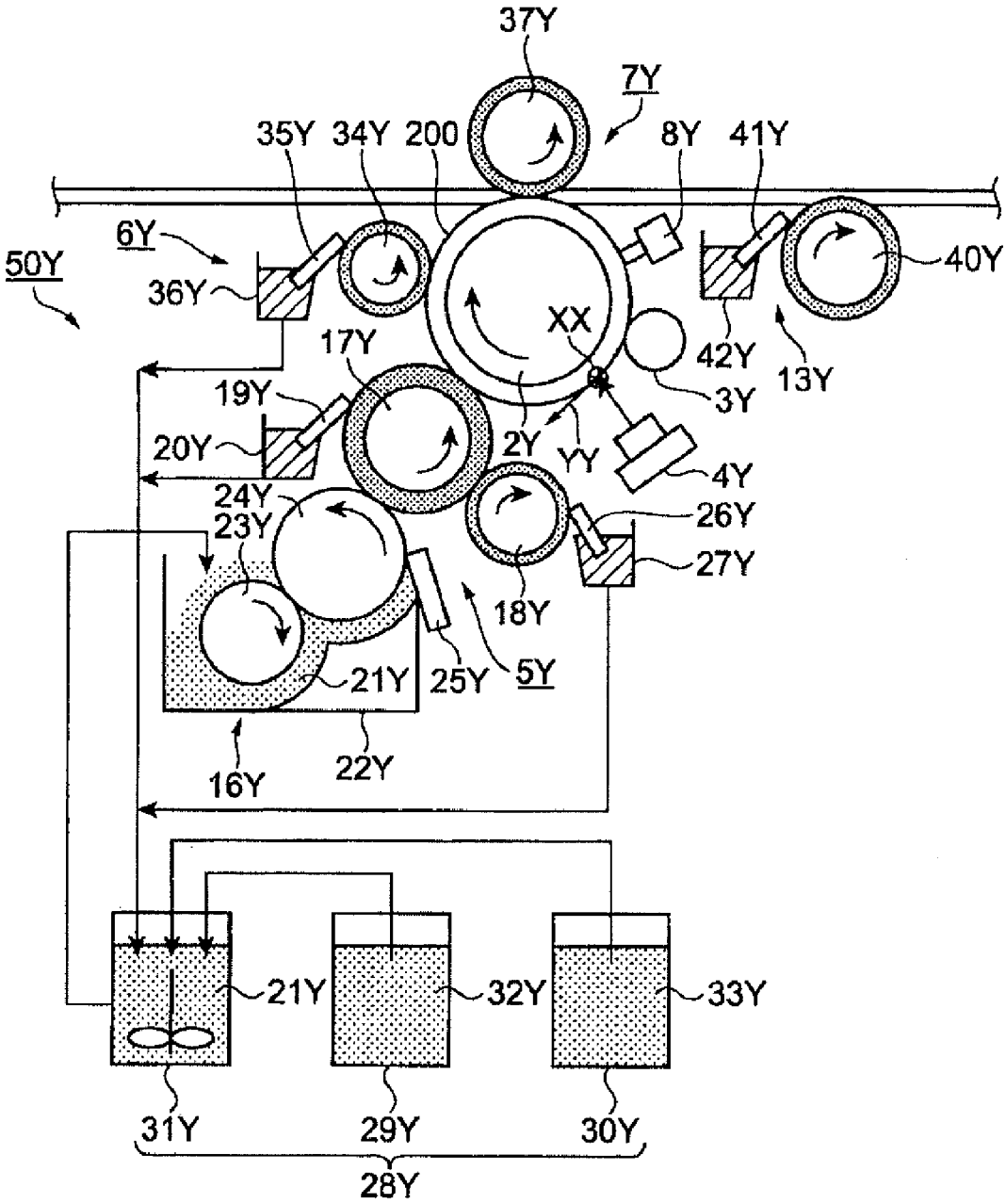
FIG. 2 is an enlarged view schematically illustrating a primary transfer unit.

FIG. 2 is an enlarged view schematically illustrating the primary transfer unit 50Y. A charging member 3Y, a line head 4Y, serving as an exposure unit, a developing device 5Y, a photoconductor squeezing device 6Y, the primary transfer device 7Y, and a neutralizing device 8Y are provided around the photoconductor 2Y in this order from the upstream side in the rotational direction of the photoconductor.

The charging member 3Y is composed of, for example, a charging roller. A bias having the same polarity as the charged liquid developer is applied from a power supply (not shown) to the charging member 3Y. Therefore, the charging member 3Y charges the photoconductor 2Y. The line head 4Y emits light from an exposure optical system using, for example, an organic EL element or an LED to a surface 200 of the photoconductor 2Y to form an electrostatic latent image on the charged photoconductor 2Y. The emission direction of light is represented by a solid arrow drawn from the line head 4Y. The line head 4Y is arranged so as to be separated from the photoconductor 2Y.

For the scanning direction of the exposure optical system, a main scanning direction XX indicates a direction that is vertical to the plane of FIG. 2, and a sub-scanning direction YY indicates a direction that is orthogonal to the main scanning direction XX and is tangent to the surface 200 of the photoconductor 2Y to which light is emitted.

Figure 3:
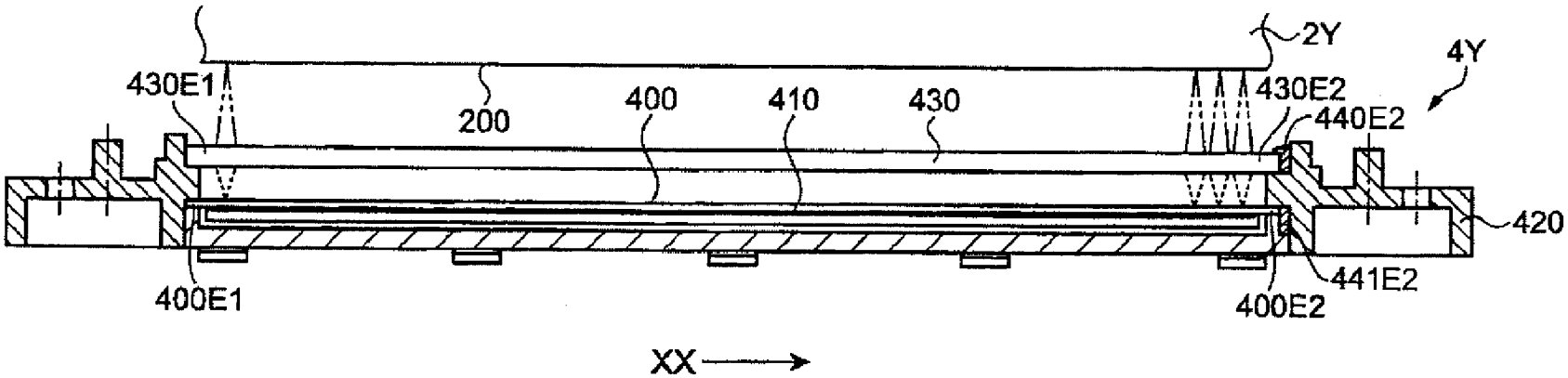
FIG. 3 is a cross-sectional view schematically illustrating a main scanning direction XX in the vicinity of a line head.
Figure 4:
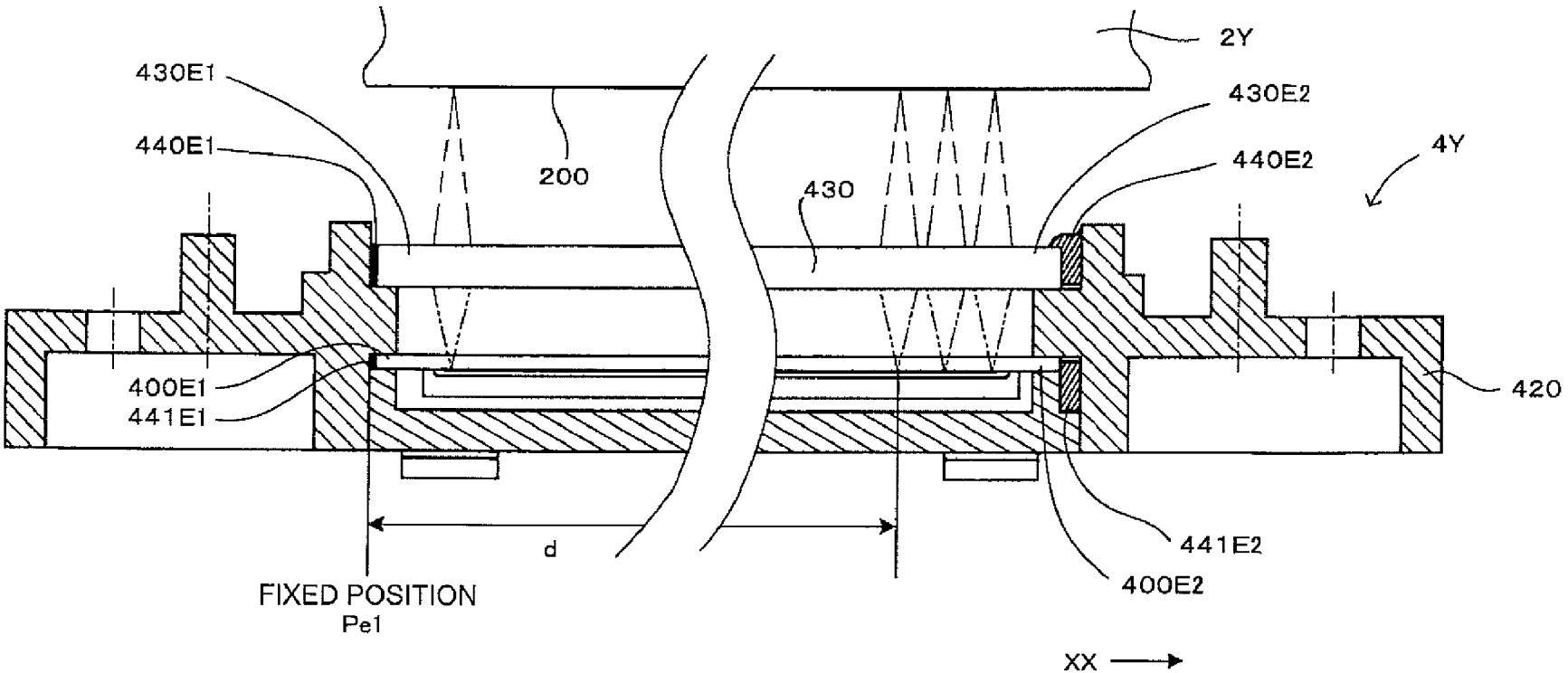
FIG. 4 is an enlarged view illustrating both ends of the line head shown in FIG. 3.

Next, the line head 4Y according to this embodiment will be described in detail with reference to the drawings. FIG. 3 is a cross-sectional view schematically illustrating the main scanning direction XX in the vicinity of the line head 4Y according to this embodiment. FIG. 4 is an enlarged view illustrating both ends of the line head shown in FIG. 3. As shown in FIG. 3, the line head 4Y includes a head substrate 400, which is a 'first substrate' of the invention, a case 420, and a lens array 430. The lens array 430 is obtained by forming lenses on a lens substrate corresponding to a 'second substrate' of the invention, will be described below. One end 430E1 of the lens array 430 in the main scanning direction XX, which is a longitudinal direction, is directly fixed to the case 420 by a fixing adhesive 440E1 to form a fixing portion. The other end 430E2 of the lens array is supported by the case 420 with an elastic member 440E2 interposed therebetween such that the other end 430E2 can be moved in the main scanning direction XX relative to the case 420. Therefore, when the ambient temperature of the line head 4Y is increased, the lens array 430 is expanded. However, since the one end 430E1 in the main scanning direction (which corresponds to the 'first direction' of the invention) XX is fixed, the other end 430E2 is thermally expanded in the main scanning direction (first direction) XX against the elastic force of the elastic member 440E2.

The head substrate 400 has the same structure as the lens array 430. That is, an one end 400E1 of the head substrate 400 in the main scanning direction XX is directly fixed to the case 420 by a fixing adhesive 441E1 to form a fixing portion, and the other end 400E2 thereof is supported by the case 420 with an elastic member 441E2 interposed therebetween such that the other end 400E2 can be moved in the main scanning direction XX relative to the case 420. Therefore, when the ambient temperature of the line head 4Y is increased, the head substrate 400 is expanded. However, since the one end 400E1 in the main scanning direction (the first direction) XX is fixed, the other end 400E2 is thermally expanded in the main scanning direction (the first direction) XX against the elastic force of the elastic member 440E2. The elastic member may be formed of an elastic adhesive. In addition, the elastic member may be formed of elastic materials other than the elastic adhesive.

One point of each of the head substrate 400 and the lens array 430 may be fixed. In this embodiment, the one end 430E1 in the main scanning direction XX is fixed, but the invention is not limited thereto. For example, the middle between both ends of the head substrate or the lens array in the longitudinal direction may be fixed, which will be described below. In addition, in this embodiment, the one end 400E1 of the head substrate 400 and the one end 430E1 of the lens array 430 are fixed by the adhesives 440E1 and 441E1, respectively, but they may be integrally fixed to the case 420 by the same adhesive. In addition, the head substrate 400 and the lens array 430 may not be connected to the case 420, but the head substrate 400 and the lens array 430 may be accommodated in the case 420 while being fixed to each other at one point.

The line head 4Y includes a plurality of light-emitting element groups 410 arranged in the main scanning direction XX. As shown in FIG. 2, these light-emitting element groups 410 emit light to the surface 200, which is a surface to be scanned with light, of the photoconductor 2Y that is charged by the charging member 3Y to form an electrostatic latent image on the surface 200.

Figure 5:
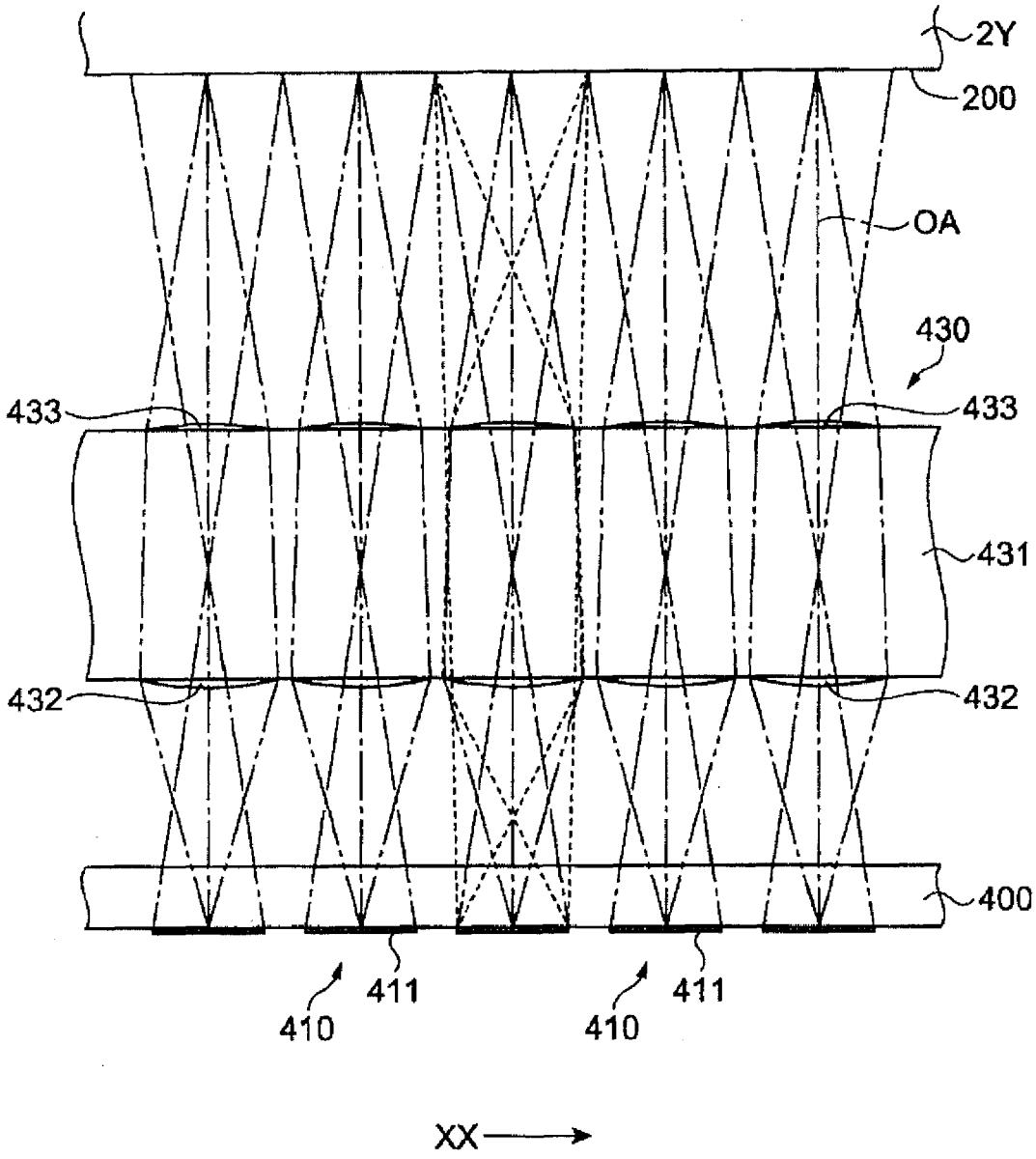
FIG. 5 is an enlarged view illustrating the vicinities of a head substrate, a lens array, and a photoconductor.
Figure 6:
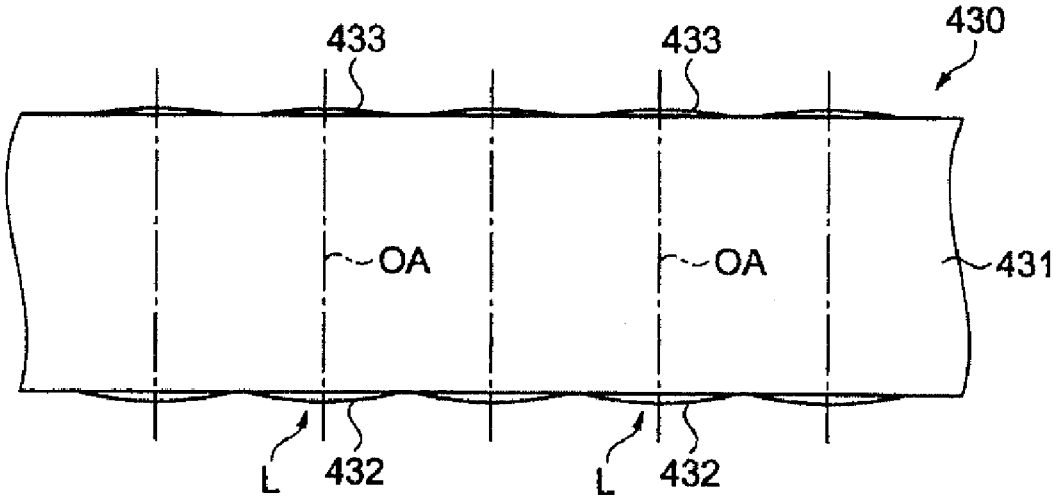
FIG. 6 is a partial cross-sectional view illustrating the lens array.

FIG. 5 is an enlarged view illustrating the vicinities of the head substrate 400, the lens array 430, and the photoconductor 2Y. FIG. 6 is a partial cross-sectional view illustrating the lens array 430. In FIG. 5, the light-emitting element groups 410 are one-dimensionally arranged on one surface of the head substrate 400 opposite to the lens array 430 in the main scanning direction XX. The light-emitting element group 410 includes a plurality of light-emitting elements 411. Organic EL elements are used as the light-emitting elements 411, and a glass substrate is used as the head substrate 400. In FIG. 5, the lens array 430 includes a lens substrate 431 and pairs of two lenses 432 and 433 corresponding to the light-emitting element groups 410. In FIG. 3, the lens array 430 is fixed by fixing the lens substrate 431.

In FIG. 6, a pair of two lenses 432 and 433 has a common optical axis OA that is represented by a one-dot chain line. In addition, a plurality of pairs of lenses are arranged so as to be in one-to-one correspondence with the plurality of light-emitting element groups 410 shown in FIG. 5. In FIG. 5, light emitted from each of the light-emitting elements 411 is focused on the photoconductor 2Y by the lenses 432 and 433, as represented by a dashed line and a two-dot chain line. An optical system according to this embodiment is an inverted optical system in which light emitted from the light-emitting element 411 is focused on a position that is inverted with respect to the optical axis OA. In the specification, an optical system including each pair of lenses 432 and 433 having a one-to-one correspondence therebetween and the lens substrate 431 interposed between the pair of lenses forms a focusing lens, which is referred to as a lens L. The lenses L are one-dimensionally arranged at predetermined intervals in the main scanning direction XX so as to correspond to the light-emitting element groups 410.

A glass substrate is used as the lens substrate 431, and the lenses 432 and 433 are formed of a resin on the surface of the lens substrate 431. The lenses 432 and 433 can be formed by arranging the liquid droplets of an ultraviolet-curable resin on the lens substrate 431 and radiating ultraviolet rays onto the liquid droplets. Alternatively, a mold may be pressed into the liquid droplets on the lens substrate 431 to make the shapes of the lenses 432 and 433, and ultraviolet rays may be radiated thereto. In this embodiment, glass substrates are used as the head substrate 400 and the lens substrate 431. In this case, the linear expansion coefficient $\alpha L$ of the lens substrate 431 is smaller than the linear expansion coefficient $\alpha E$ of the head substrate 400.

Figure 7:
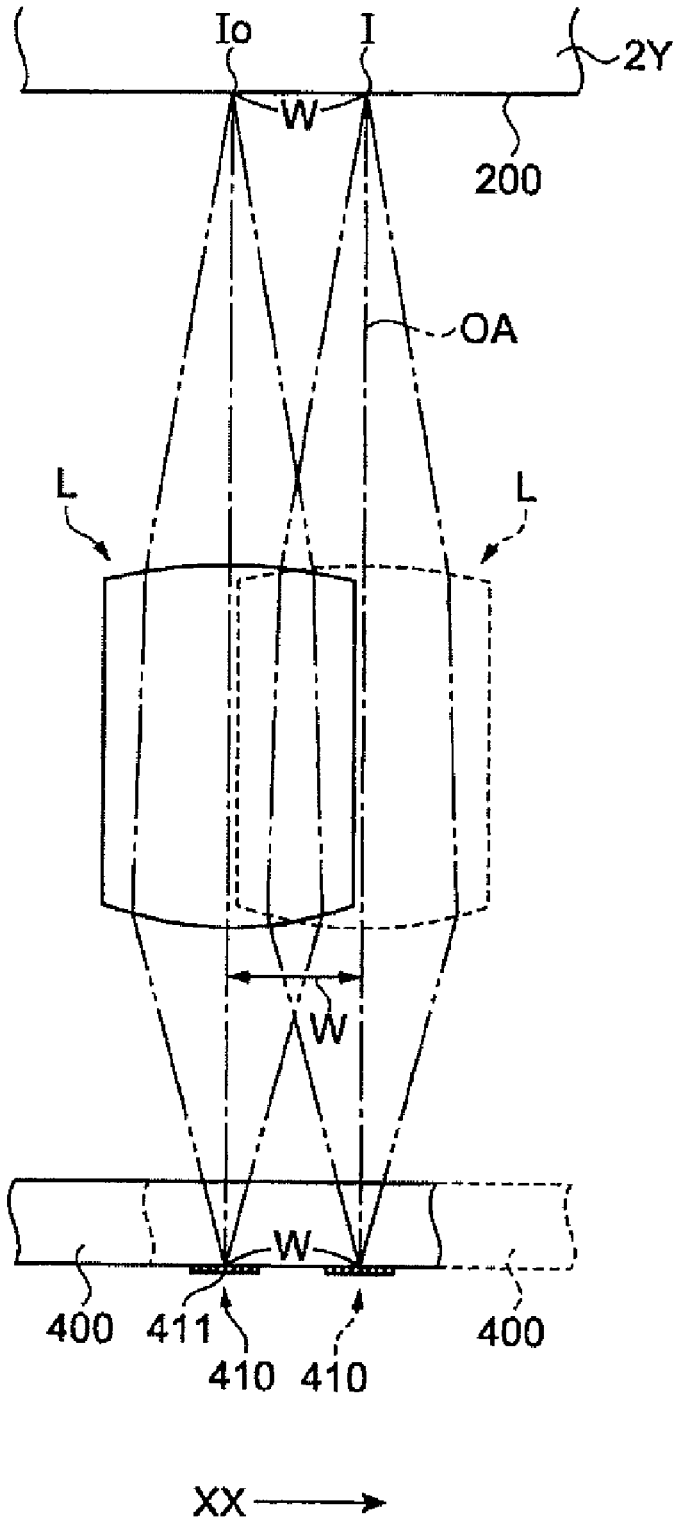
FIG. 7 is a partial cross-sectional view illustrating a case in which the head substrate and the lens substrate have the same linear expansion coefficient.
Figure 8:
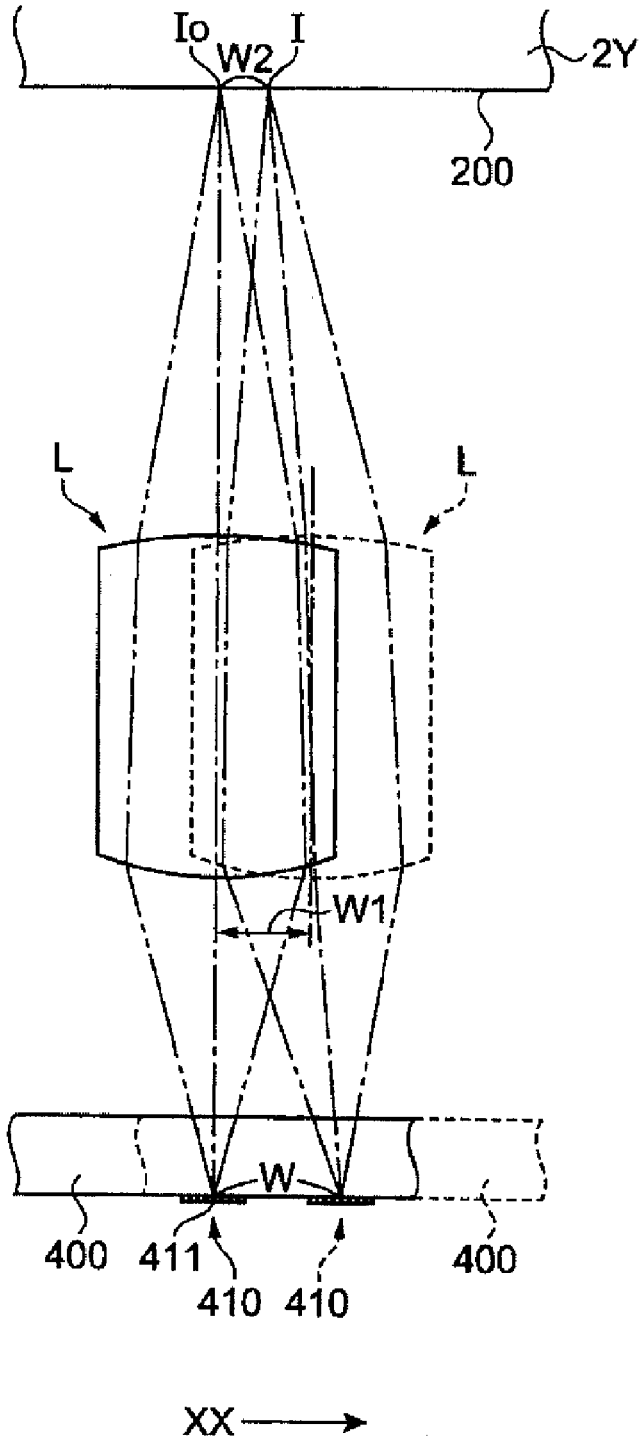
FIG. 8 is a partial cross-sectional view illustrating a case in which the head substrate and the lens substrate have different linear expansion coefficients.
Figure 9:
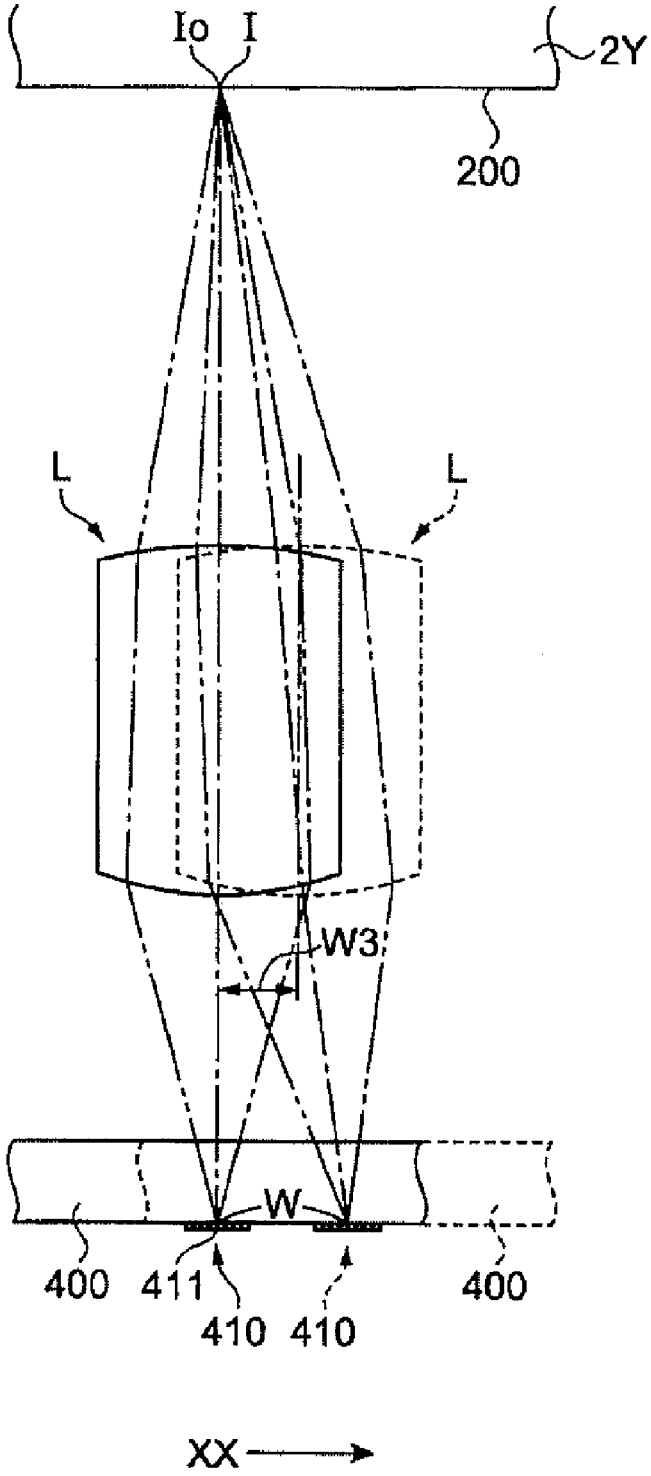
FIG. 9 is a partial cross-sectional view illustrating a case in which the head substrate and the lens substrate have different linear expansion coefficients.

FIG. 7 is a partial cross-sectional view illustrating a case in which the linear expansion coefficient of the head substrate 400 is substantially equal to that of the lens substrate 431. FIGS. 8 and 9 are partial cross-sectional views illustrating a case in which the linear expansion coefficients are different from each other. In the drawings, the positions of the head substrate 400 and the lens L after thermal expansion by the application of heat are represented by dashed lines. In addition, the focal position of light emitted from the light-emitting element 411 on the surface 200 before thermal expansion is referred to as I0, and the focal position of light emitted from the light-emitting element 411 on the surface 200 after thermal expansion is referred to as I.

When the distance from the fixed one end of each of the head substrate 400 and the lens substrate 431 to the target light-emitting element 411 and lens L is d (see FIG. 4) and the temperature is increased by 1° C. by heat, the movement distance of the lens L is $d \times \alpha L$, and the movement distance of the light-emitting element 411 is $d \times \alpha E$. Next, a movement distance per 1° C. will be described.

After thermal expansion, the positional deviation between the light-emitting element 411 and the optical axis OA of the lens L is a difference $d \times (\alpha E - \alpha L)$ between the movement distance $d \times \alpha L$ of the lens L and the movement distance $d \times \alpha E$ of the light-emitting element 411. The focal position of light emitted from the light-emitting element 411 on the surface 200 with respect to the optical axis OA of the lens L is $m \times d \times (\alpha E - \alpha L)$ (where m indicates the optical magnification of the lens L and has a negative value in the inverted optical system). Therefore, the movement distance of the actual focal position I is $d \times \alpha L + m \times d(\alpha E - \alpha L)$ that is obtained by adding $m \times d(\alpha E - \alpha L)$ to the movement distance $d \times \alpha L$ of the lens L.

When the head substrate 400 and the lens substrate 431 have the same linear expansion coefficient, in FIG. 7, the head substrate 400 and the lens L are moved the same distance $W = d \times \alpha L(\alpha E)$. Therefore, the position of the light-emitting element 411 relative to the optical axis OA does not vary, and the focal position I after thermal expansion is also moved by the distance W.

When the linear expansion coefficient of the lens substrate 431 is smaller than that of the head substrate 400, in FIG. 8, the movement distance W of the head substrate 400 is $d \times \alpha E$, and the lens L is moved a distance $W1 = d \times \alpha L$. In this case, W1 is smaller than W. The focal position I is moved a distance $W2 = d \times \alpha L + m \times d \times (\alpha E - \alpha L)$ in a direction that is opposite to the movement direction of the lens L with respect to the movement distance W1 of the lens L, since the lens is an inverted optical system. In this case, since m is a negative value and $(\alpha E - \alpha L)$ is a positive value, the distances satisfy $W2 < W1 < W$. Therefore, the focal position I is close to the original focal position I0, as compared to when the head substrate 400 and the lens substrate 431 have the same linear expansion coefficient.

When the linear expansion coefficient of the head substrate 400 and the linear expansion coefficient of the lens substrate 431 satisfy $\alpha L + m(\alpha E - \alpha L) = 0$, in FIG. 9, light emitted from the light-emitting element 411 is focused on a position that is moved a distance that is equal to the movement distance W3 of the lens L in a direction that is opposite to the movement direction of the lens L. Therefore, the focal position I overlaps the original focal position I0.

Next, the linear expansion coefficient $\alpha E$ of the head substrate 400 and the linear expansion coefficient $\alpha L$ of the lens substrate 431 will be described in detail with reference to Examples and modifications.

Example 1

The head substrate 400 was formed of soda glass ($\alpha E$: $9 \times 10^{-6}$/° C.) and the lens substrate 431 was formed of Pyrex (registered trademark) ($\alpha L$: $3.25 \times 10^{-6}$/° C.). The optical magnification was −0.5. The movement distance of the focal position I per unit length was $0.375 \times 10^{-6}$, which was one-tenth or less of the movement distance when the linear expansion coefficient $\alpha L$ of the lens substrate 431 was equal to the linear expansion coefficient $\alpha E$ (=$9 \times 10^{-6}$/° C.) of the head substrate 400. The lens substrate may be formed of Duran (registered trademark) ($\alpha L$: $3.3 \times 10^{-6}$/° C.) or OA-10 (registered trademark) ($\alpha L$: $3.8 \times 10^{-6}$/° C.).

Example 2

The head substrate 400 was formed of OA-10 (registered trademark) ($\alpha L$: $3.8 \times 10^{-6}$/° C.), and the lens substrate 431 was formed of quartz glass ($\alpha L$: $0.4 \times 10^{-6}$/° C.). The optical magnification was −1.5. The movement distance of the focal position I per unit length was $-0.62 \times 10^{-6}$, which was less than the movement distance when the linear expansion coefficient of the lens substrate 431 was equal to the linear expansion coefficient (=$9 \times 10^{-6}$/° C.) of the head substrate 400.

Example 3

The head substrate 400 was formed of OA-10 (registered trademark) ($\alpha L$: $3.8 \times 10^{-6}$/° C.), and the lens substrate 431 was formed of borosilicate glass ($\alpha L$: $2.2 \times 10^{-6}$/° C.). The optical magnification was −1.5. The movement distance of the focal position I per unit length was $-0.2 \times 10^{-6}$, which was one-tenth or less of the movement distance when the linear expansion coefficient of the lens substrate 431 was equal to the linear expansion coefficient (=$9 \times 10^{-6}$/° C.) of the head substrate 400.

Modification 1

The light-emitting element may be an LED, and a glass epoxy substrate ($\alpha L$: $1.5 \times 10^{-5}$/° C.) may be used as the head substrate 400. When the LED is used, the LED is provided on one surface of the head substrate 400 facing the lens substrate 431. The lens substrate 431 is formed of soda glass ($\alpha L$: $9.00 \times 10^{-6}$/° C.), and the optical magnification is −1.5. In this case, the movement distance of the focal position I per unit length is 0. Therefore, there is no movement of the focal position I.

Next, the developing device 5Y will be described with reference to FIG. 2. The developing device 5Y develops the electrostatic latent image formed on the photoconductor 2Y using a liquid developer 21Y. In FIG. 2, the developing device 5Y includes a developer supply unit 16Y, a developing roller 17Y, a compaction roller 18Y, a developing roller cleaner 19Y, and a developing roller cleaner liquid collection container 20Y.

The developer supply unit 16Y includes a developer container 22Y that stores a liquid developer 21Y including toner particles and a non-volatile liquid carrier, a developing drawing roller 23Y, an anilox roller 24Y, and a developer regulating blade 25Y.

In the liquid developer 21Y contained in the developer container 22Y, particles that are obtained by dispersing a known coloring agent, such as pigment, in a thermoplastic resin used for toner and have an average particle diameter of, for example, 1 μm may be used as toner. In addition, for example, in order to obtain a liquid developer having low viscosity and low concentration, any of the following materials may be used as a liquid carrier: an organic solvent; a silicon oil having a flash point of 210° C. or more, such as phenylmethyl siloxane, dimethyl polysiloxane, or polydimethylcyclo siloxane; and an insulating liquid carrier, such as mineral oil. In this embodiment, in the liquid developer 21Y, toner particles and a dispersant are added to the liquid carrier, and the solid content concentration of toner is about 20%.

The developer drawing roller 23Y draws up the liquid developer 21Y contained in the developer container 22Y and supplies it to the anilox roller 24Y. The developer drawing roller 23Y is rotated in the clockwise direction that is represented by an arrow in FIG. 2. The anilox roller 24Y has fine and uniform spiral grooves formed in the surface of a cylindrical member. For example, the pitch between the grooves is about 130 μm, and the depth of the groove is about 30 μm. However, the dimensions of the groove are not limited thereto. The anilox roller 24Y is rotated in the same direction as the developing roller 17Y. That is, the anilox roller 24Y is rotated in the counterclockwise direction that is represented by an arrow in FIG. 2. In addition, the anilox roller 24Y may be rotated in the clockwise direction together with the developing roller 17Y. That is, the rotational direction of the anilox roller 24Y is not particularly limited.

The developer regulating blade 25Y is provided so as to come into contact with the surface of the anilox roller 24Y. The developer regulating blade 25Y includes a rubber portion that is made of, for example, urethane rubber and comes into contact with the surface of the anilox roller 24Y and a metal plate that supports the rubber portion. The developer regulating blade 25Y scrapes and removes the liquid developer 21Y adhered to a portion of the surface of the anilox roller 24Y other than the grooves using the rubber portion. Therefore, the anilox roller 24Y supplies only the liquid developer 21Y adhered to the grooves to the developing roller 17Y.

For example, the developing roller 17Y includes a shaft that is made of a metal material, such as iron, and a cylindrical conductive elastic material that has a predetermined width, includes a conductive resin layer or a conductive rubber layer made of, for example, conductive urethane rubber, and is provided on the outer circumferential surface of the shaft. The developing roller 17Y comes into contact with the photoconductor 2Y, and is rotated in the counterclockwise direction, as represented by an arrow in FIG. 2.

The compaction roller 18Y is provided such that the outer circumferential surface thereof comes into contact with the outer circumferential surface of the developing roller 17Y. In this case, the compaction roller 18Y and the developing roller 17Y are pressed against each other such that their outer circumferential surfaces are pressed back by a predetermined amount.

The compaction roller 18Y is rotated in the clockwise direction, as represented by an arrow in FIG. 2. When a voltage is applied to the compaction roller 18Y, the compaction roller 18Y charges the developing roller 17Y. In this case, a direct current (DC) voltage is applied to the compaction roller 18Y. A superimposed voltage of a DC voltage and an alternating current (AC) voltage may be applied to the compaction roller 18Y.

By charging the developing roller 17Y with the compaction roller 18Y, the compaction roller 18Y applies a contact compaction to the liquid developer 21Y on the developing roller 17Y.

The contact compaction applied by the compaction roller 18Y causes the liquid developer 21Y on the developing roller 17Y to be pressed against the developing roller 17Y.

The compaction roller 18Y includes a compaction roller cleaner blade 26Y and a compaction roller cleaner liquid collection container 27Y. The compaction roller cleaner blade 26Y is made of, for example, rubber that comes into contact with the surface of the compaction roller 18Y, and scrapes and removes the liquid developer 21Y remaining on the compaction roller 18Y. The compaction roller cleaner liquid collection container 27Y is composed of a container, such as a tank, that stores the liquid developer 21Y removed from the compaction roller 18Y by the compaction roller cleaner blade 26Y.

The developing roller cleaner 19Y is made of, for example, rubber that comes into contact with the surface of the developing roller 17Y, and scrapes and removes the liquid developer 21Y remaining on the developing roller 17Y. The developing roller cleaner liquid collection container 20Y is composed of a container, such as a tank, that stores the liquid developer 21Y removed from the developing roller 17Y by the developing roller cleaner 19Y.

The image forming apparatus 1 further includes a developer refill device 28Y that refills the developer container 22Y with the liquid developer 21Y. The developer refill device 28Y includes a toner tank 29Y, a carrier tank 30Y, and an agitator 31Y.

A high-concentration liquid toner 32Y is stored in the toner tank 29Y, and a liquid carrier (carrier oil) 33Y is stored in the carrier tank 30Y. A predetermined amount of high-concentration liquid toner 32Y is supplied from the toner tank 29Y to the agitator 31Y, and a predetermined amount of liquid carrier 33Y is supplied from the carrier tank 30Y to the agitator 31Y.

The agitator 31Y mixes and agitates the supplied high-concentration liquid toner 32Y with the supplied liquid carrier 33Y to produce the liquid developer 21Y to be used in the developing device 5Y. In this case, it is preferable that the overall viscosity of the liquid developer 21Y be in the range of 100 mPas to 1000 mPas and the viscosity of the liquid carrier (carrier oil) 33Y be in the range of 10 mPas to 200 mPas. The viscosity is measured by, for example, a viscoelasticity measuring apparatus ARES (manufactured by TA Instruments, Japan). The liquid developer 21Y produced by the agitator 31Y is supplied to the developer container 22Y.

The photoconductor squeezing device 6Y includes a squeeze roller 34Y, a squeeze roller cleaner 35Y, and a squeeze roller cleaner liquid collection container 36Y. The squeeze roller 34Y is disposed on the downstream side of a contact portion (nip portion) between the photoconductor 2Y and the developing roller 17Y in the direction in which the photoconductor 2Y is rotated. The squeeze roller 34Y is rotated in a direction (in the counterclockwise direction in FIG. 2) opposite to the rotational direction of the photoconductor 2Y to remove the liquid developer 21Y on the photoconductor 2Y.

The liquid developer 21Y collected in the compaction roller cleaner liquid collection container 27Y, the developing roller cleaner liquid collection container 20Y, and the squeeze roller cleaner liquid collection container 36Y returns to the agitator 31Y to be reused.

An elastic roller having an elastic member, such as conductive urethane rubber, and a fluororesin outer layer provided on the surface of a metal core is preferably used as the squeeze roller 34Y. The squeeze roller cleaner 35Y is made of an elastic material, such as rubber, and comes into contact with the surface of the squeeze roller 34Y to scrape and remove the liquid developer 21Y remaining on the squeeze roller 34Y. The squeeze roller cleaner liquid collection container 36Y is a container, such as a tank, that stores the liquid developer 21Y removed by the squeeze roller cleaner 35Y.

A voltage of about −200 V having a polarity that is opposite to the charged polarity of the toner particles is applied to the backup roller 37Y to primarily transfer an image formed by the liquid developer 21Y on the photoconductor 2Y to the intermediate transfer belt 10. Further, the neutralizing device 8Y removes the charge remaining on the photoconductor 2Y after the primary transfer.

The intermediate transfer belt squeezing device 13Y includes an intermediate transfer belt squeeze roller 40Y, an intermediate transfer belt squeeze roller cleaner 41Y, and an intermediate transfer belt squeeze roller cleaner liquid collection container 42Y. The intermediate transfer belt squeeze roller 40Y is for collecting the liquid developer 21Y on the intermediate transfer belt 10. The intermediate transfer belt squeeze roller cleaner 41Y scrapes away the liquid developer 21Y collected on the intermediate transfer belt squeeze roller 40Y. The intermediate transfer belt squeeze roller cleaner 41Y is made of an elastic material, such as rubber, similar to the squeeze roller cleaner 35Y. The intermediate transfer belt squeeze roller cleaner liquid collection container 42Y collects and stores the liquid developer 21Y removed by the intermediate transfer belt squeeze roller cleaner 41Y.

When an image forming operation starts, the photoconductor 2Y is uniformly charged by the charging member 3Y. Then, an electrostatic latent image is formed on the photoconductor 2Y by the line head 4Y.

Then, in the developing device 5Y, the yellow (Y) liquid developer 21Y is drawn up to the anilox roller 24Y by the developer drawing roller 23Y. An appropriate amount of liquid developer 21Y is adhered to the grooves of the anilox roller 24Y by the developer regulating blade 25Y. The liquid developer 21Y in the grooves of the anilox roller 24Y is supplied to the developing roller 17Y.

In this case, a portion of the liquid developer 21Y in the grooves of the anilox roller 24Y moves to the left and right ends of the anilox roller 24Y. Further, the toner particles of the yellow (Y) liquid developer 21Y on the developing roller 17Y are pressed against the developing roller 17Y by the contact compaction by the compaction roller 18Y. The liquid developer 21Y on the developing roller 17Y is transported to the photoconductor 2Y by the rotation of the developing roller 17Y while being compacted.

After the contact compaction by the compaction roller 18Y is completed, the liquid developer 21Y remaining on the compaction roller 18Y is removed from the compaction roller 18Y by the compaction roller cleaner blade 26Y.

The electrostatic latent image formed on the yellow (Y) photoconductor 2Y is developed by the yellow (Y) liquid developer 21Y in the developing device 5Y, and an image is formed on the photoconductor 2Y by the yellow (Y) liquid developer 21Y. After the image is developed, the liquid developer 21Y remaining on the developing roller 17Y is removed from the developing roller 17Y by the developing roller cleaner 19Y. The image formed by the yellow (Y) liquid developer 21Y on the photoconductor 2Y is changed into a yellow (Y) toner image by collecting the liquid developer 21Y on the photoconductor 2Y using the squeeze roller 34Y. Further, the yellow (Y) toner image is transferred onto the intermediate transfer belt 10 by the primary transfer device 7Y. The yellow (Y) toner image on the intermediate transfer belt 10 is transported to the magenta (M) primary transfer device 7M shown in FIG. 1 while the liquid developer 21Y on the intermediate transfer belt 10 is collected by the intermediate transfer belt squeeze roller 40Y.

In FIG. 1, an electrostatic latent image formed on the magenta (M) photoconductor 2M is developed with a magenta (M) liquid developer in the developing device 5M by the same method as that in the yellow (Y) developing device, and an image is formed by the magenta (M) liquid developer on the photoconductor 2M. At this time, the carrier remaining on a compaction roller 18M after the contact compaction by the compaction roller 18M is completed is removed from the compaction roller 18M by a compaction roller cleaner blade 26M. After the image is developed, the liquid developer remaining on the developing roller 17M is removed from the developing roller 17M by a developing roller cleaner 19M.

The image formed on the photoconductor 2M by the magenta (M) liquid developer is changed into a magenta (M) toner image by collecting the liquid developer on the photoconductor 2M using the squeeze roller 34M. The magenta (M) toner image is transferred onto the intermediate transfer belt 10 by the primary transfer device 7M to be superimposed on the yellow (Y) toner image. Similarly, the superimposed image of the yellow (Y) and magenta (M) toner images is transported to the cyan (C) primary transfer device 7C while the liquid developer on the intermediate transfer belt 10 is collected by the intermediate transfer belt squeeze roller 40M. Then, similarly, a cyan (C) toner image and a black (K) toner image are transferred onto the intermediate transfer belt 10 and then superimposed. In this way, a full color toner image is formed on the intermediate transfer belt 10.

Then, the color toner image on the intermediate transfer belt 10 is secondarily transferred onto a transfer surface of a transfer material, such as a sheet, by the secondary transfer device 14. The color toner image transferred onto the transfer material is fixed by a fixing device (not shown) by the same method as that in the related art, and the transfer material having the full color fixed image formed thereon is transported to the sheet discharge tray. In this way, the color image forming operation is completed.

This embodiment has the following effects.

(1) When heat is applied to the line head 4Y, each of the head substrate 400 and the lens substrate 431 is expanded from the one end 400E1 or 430E1 since the one end 400E1 or 430E1 of each of the head substrate 400 and the lens substrate 431 is fixed. In this embodiment, since the linear expansion coefficient $\alpha L$ of the lens substrate 431 is smaller than the linear expansion coefficient $\alpha E$ of the head substrate 400, the positional deviation between the light-emitting element 411 and the lens L occurs. For this positional deviation, since the lens L is an inverted optical system, the focal position I of light emitted from the light-emitting element 411 is moved in a direction that is opposite to the direction in which the lens L is expanded, and the positional deviation between the focal position I after thermal expansion and the original focal position I0 can be reduced. Therefore, it is possible to obtain the line head 4Y and the image forming apparatus 1 in which the movement of the focal position I due to thermal expansion is small.

(2) Since the one end 400E1 or 430E1 of each of the head substrate 400 and the lens substrate 431 in the main scanning direction XX, which is a longitudinal direction, is fixed, the positional deviation between the other ends 400E2 and 430E2 of the head substrate 400 and the lens substrate 431 due to thermal expansion is large. Therefore, it is possible to effectively obtain the line head 4Y and the image forming apparatus 1 in which the movement of the focal position I is small.

(3) Since the head substrate 400 and the lens substrate 431 are fixed to and supported by the case 420, it is possible to reduce the positional deviation between the line head 4Y, and the head substrate 400 and the lens substrate 431, and obtain the line head 4Y and the image forming apparatus 1 in which the movement of the focal position I due to thermal expansion is small. In addition, since one end of each of the head substrate and the lens substrate in the main scanning direction XX is supported by the adhesives 440 and 441, the thermal expansion of the head substrate 400 and the lens substrate 431 is prevented, and the distortion of the head substrate 400 and the lens substrate 431 is reduced. Therefore, it is possible to obtain the line head 4Y and the image forming apparatus 1 in which the movement of the focal position I is small.

(4) Since the linear expansion coefficient $\alpha L$ of the lens substrate 431 and the linear expansion coefficient $\alpha E$ of the head substrate 400 satisfy the above-mentioned expression, the movement distance of the lens L is equal to the movement distance of the focal position I relative to the lens L, and it is possible to remove the deviation of the focal position I after thermal expansion. Therefore, it is possible to obtain the line head 4Y and the image forming apparatus 1 in which the movement of the focal position I due to thermal expansion is small.

Second Embodiment

Figure 10:
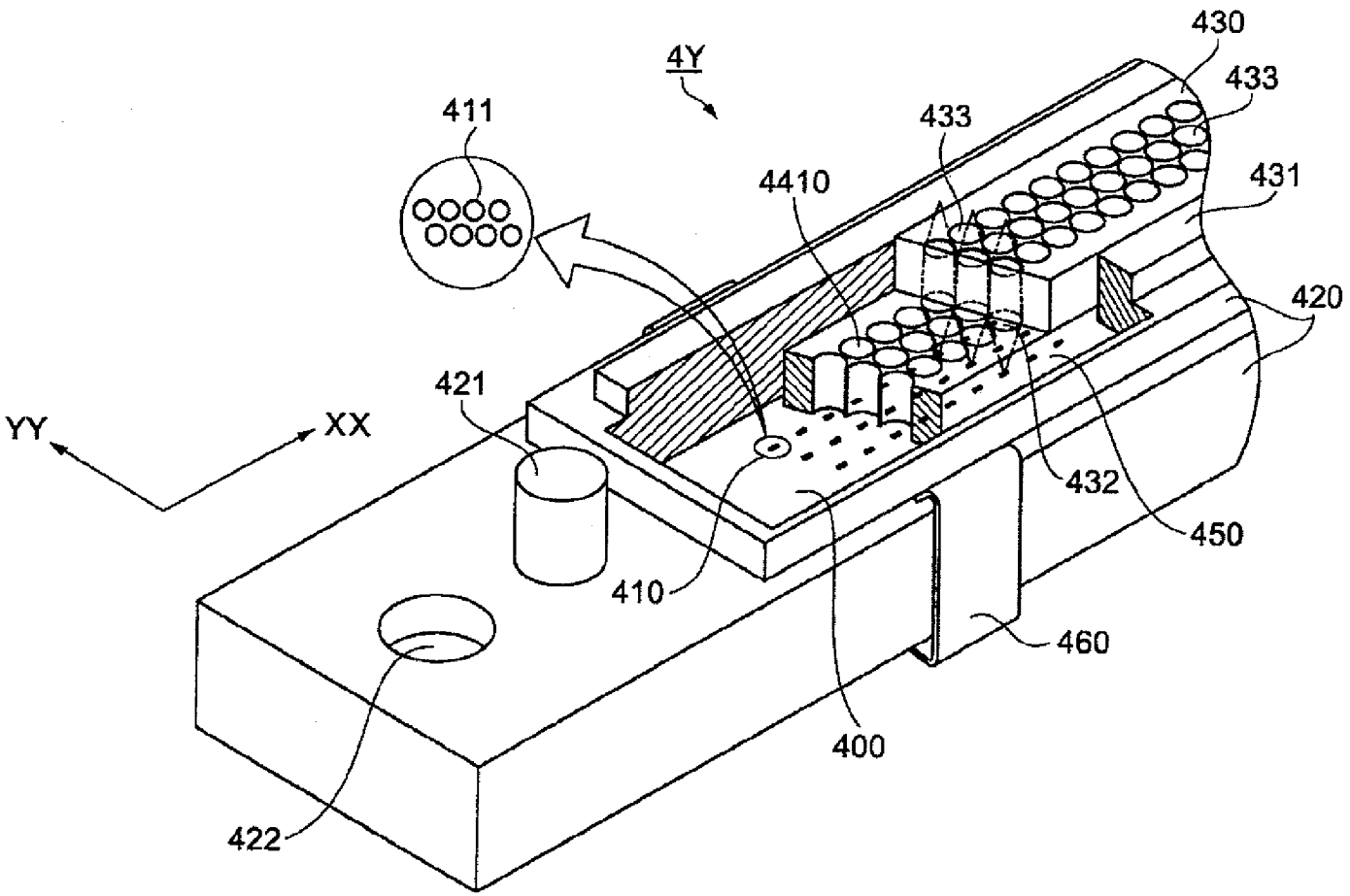
FIG. 10 is a perspective view schematically illustrating a line head according to a second embodiment of the invention.
Figure 11:
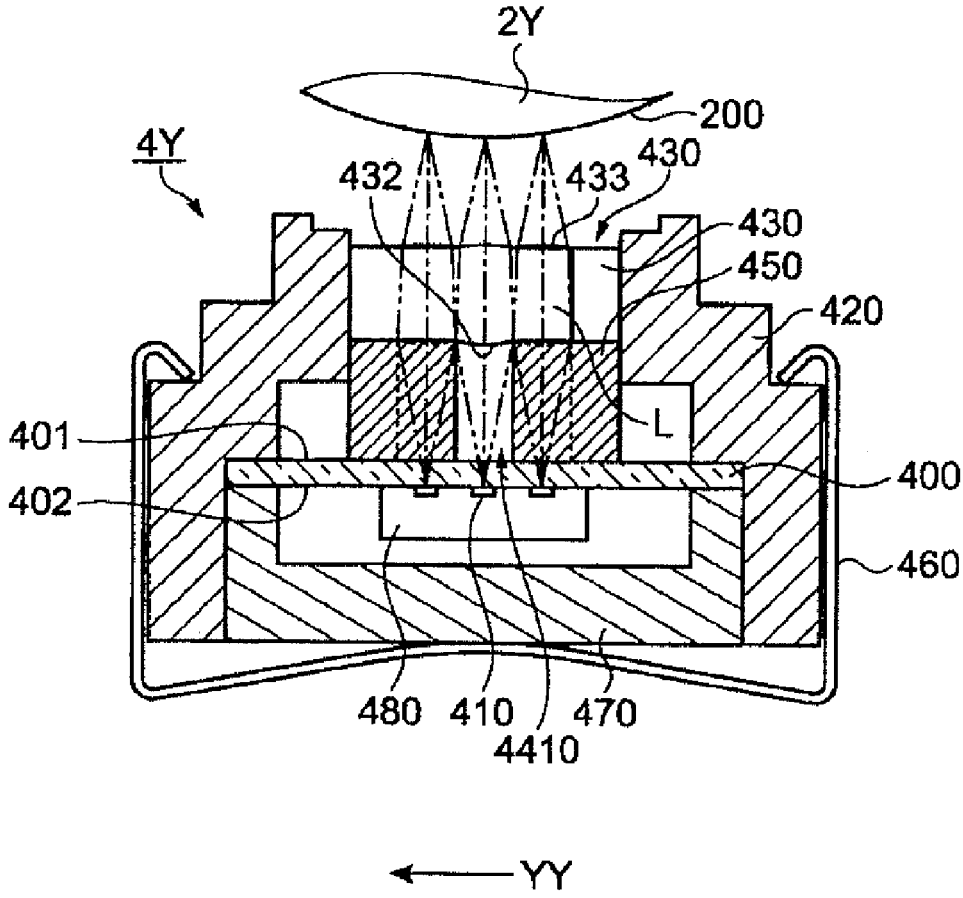
FIG. 11 is a cross-sectional view illustrating a sub-scanning direction YY of the line head.

FIG. 10 is a perspective view schematically illustrating a line head 4Y according to a second embodiment of the invention. FIG. 11 is a cross-sectional view illustrating the sub-scanning direction YY of the line head 4Y. In this embodiment, members having the same functions as those in the first embodiment are denoted by the same reference numerals. In FIG. 10, the line head 4Y includes light-emitting element groups 410 arranged in the main scanning direction XX and the sub-scanning direction YY. Each of the light-emitting element groups 410 includes a plurality of light-emitting elements 411. As shown in FIG. 2, these light-emitting elements 411 emit light to the surface 200, which is a surface to be scanned, of the photoconductor 2Y that is charged by the charging member 3Y to form an electrostatic latent image on the surface 200.

In FIG. 10, the line head 4Y according to this embodiment includes a case 420 having the main scanning direction XX as the longitudinal direction thereof. Positioning pins 421 and screw insertion holes 422 are provided at both ends of the case 420. The line head 4Y is positioned relative to the photoconductor 2Y shown in FIG. 2 by fitting the positioning pins 421 into positioning holes formed in a photoconductor cover (not shown). The photoconductor cover covers the photoconductor 2Y and is positioned relative to the photoconductor 2Y. Further, the line head 4Y is positioned and fixed to the photoconductor 2Y by fitting fixing screws into screw holes (not shown) of the photoconductor cover through the screw insertion holes 422.

In FIGS. 10 and 11, the case 420 holds the lens array 430 having focusing lenses arrayed on a lens substrate (which corresponds to a 'second substrate' of the invention) 431, at a position that faces the surface 200 of the photoconductor 2Y, and includes a light-shielding member 450 and a head substrate 400, serving as a 'first substrate' of the invention, arranged in this order from the lens array 430. The head substrate 400 is a transparent glass substrate.

The lens array 430 includes a lens substrate 431, lenses 432, and lenses 433. Each pair of the lens 432 and the lens 433 forms a lens L. The lenses L are two-dimensionally arranged on the lens substrate 431 so as to correspond to the light-emitting element groups 410 that are two-dimensionally arranged.

A plurality of light-emitting element groups 410 are provided on a surface 402 of the head substrate 400 (one surface that is opposite to the other surface 401 facing the light-shielding member 450 of two surfaces of the head substrate 400). The plurality of light-emitting element groups 410 are two-dimensionally arranged on the surface 402 of the head substrate 400 at predetermined intervals in the main scanning direction XX and the sub-scanning direction YY, as shown in FIG. 10. Each light emitting element group 410 is formed by two-dimensionally arranging a plurality of light emitting elements 411, as represented by a circle in FIG. 10.

In this embodiment, organic EL elements are used as the light-emitting elements. That is, in this embodiment, the organic EL elements are arranged as the light-emitting elements 411 on the surface 402 of the head substrate 400. Light emitted from each of the plurality of light-emitting elements 411 to the photoconductor 2Y passes through the head substrate 400 and travels to the light-shielding member 450. The light-emitting elements may be LEDs. In this case, the substrate may not be a glass substrate, and the LEDs may be provided on the surface 401.

In FIGS. 10 and 11, the light-shielding member 450 includes a plurality of light guide holes 4410 that are in one-to-one correspondence with a plurality of light-emitting element groups 410.

In FIGS. 10 and 11, light emitted from the light-emitting elements 411 belonging to each of the light-emitting element groups 410 is guided to the lens array 430 by the light guide holes 4410 that are in one-to-one correspondence with the light-emitting element groups 410. Light passing through the light guide holes 4410 is focused as a spot on the surface 200 of the photoconductor 2Y by the lens array 430, as represented by two-dot chain lines.

As shown in FIG. 11, a rear cover 470 is pressed against the case 420 through the head substrate 400 by a fixing member 460. Specifically, the fixing member 460 has an elastic force to press the rear cover 470 against the case 420, and presses the rear cover 470 using the elastic force to light-tightly seal the inside of the case 420 (that is, such that no light leaks from the inside of the case 420 and no light is incident into the case 420 from the outside). A plurality of fixing members 460 are provided in the longitudinal direction of the case 420 shown in FIG. 10. The light-emitting element groups 410 are covered with a sealing member 480.

Figure 12:
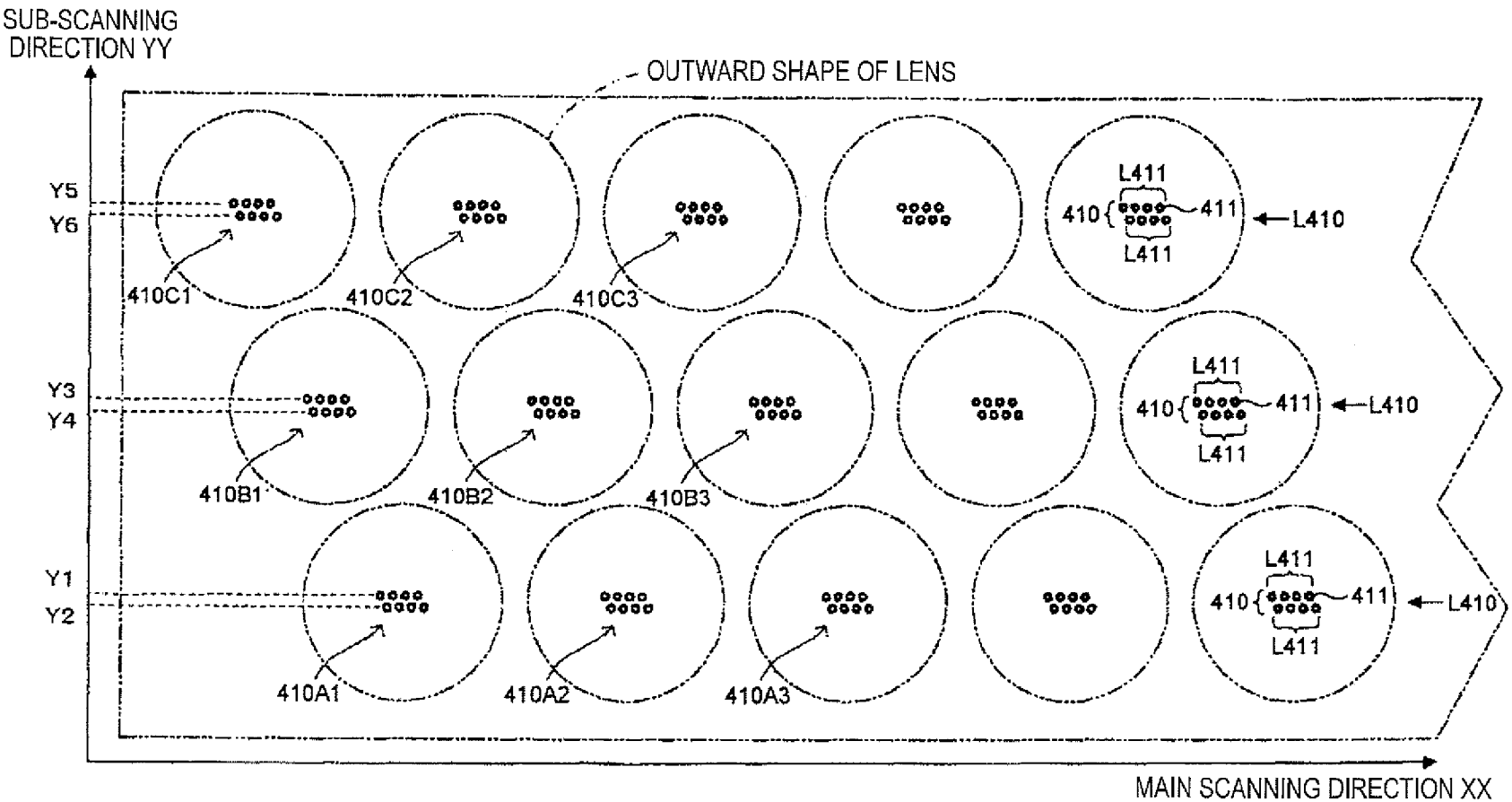
FIG. 12 is a diagram illustrating the arrangement of a plurality of light-emitting element groups.

FIG. 12 is a diagram illustrating the arrangement of the plurality of light-emitting element groups 410.

In this embodiment, two light-emitting element rows L411, each including four light-emitting elements 411 arranged at predetermined intervals in the main scanning direction XX, are arranged in the sub-scanning direction YY to form one light-emitting element group 410. That is, eight light-emitting elements 411 form one light-emitting element group 410 corresponding to the position of the outer diameter of one lens represented by a two-dot chain line circle in FIG. 12. A plurality of light-emitting element groups 410 are arranged as follows.

The light-emitting element groups 410 are two-dimensionally arranged such that three light-emitting element group rows L410 (group rows), each including a predetermined number (two or more) of light-emitting element groups 410 arranged in the main scanning direction XX, are arranged in the sub-scanning direction YY. The light-emitting element groups 410 in each light-emitting element group row L410 are arranged at different main scanning direction positions. Further, the plurality of light-emitting element groups 410 are arranged such that the light-emitting element groups (for example, light-emitting element groups 410C1 and 410B1) adjacent to each other in the main scanning direction are disposed at different sub-scanning direction positions. The main scanning direction position and the sub-scanning direction position mean a main scanning direction component and a sub-scanning direction component of a target position, respectively.

Figure 13:
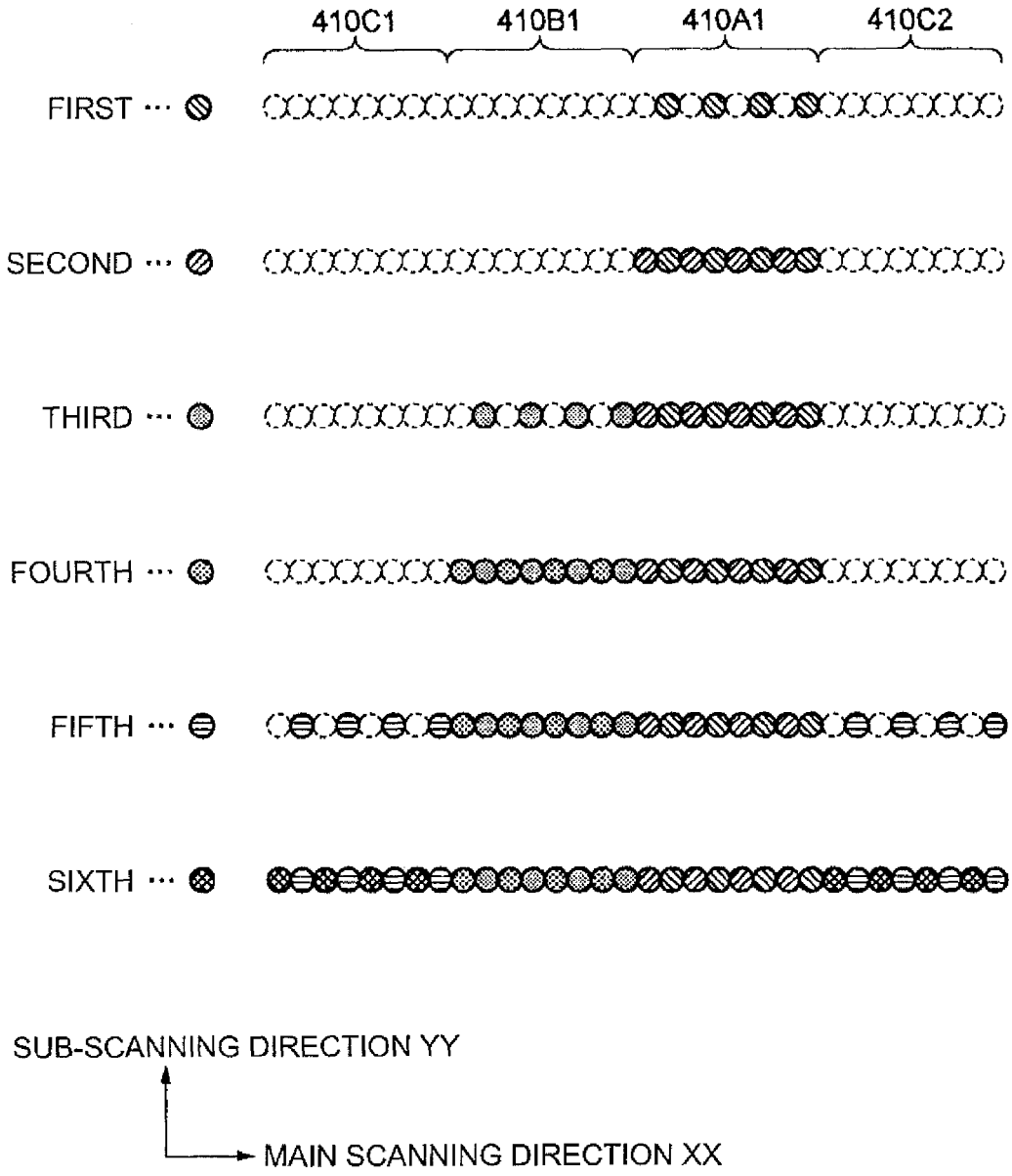
FIG. 13 is a diagram illustrating a spot forming operation of the line head.

FIG. 13 is a diagram illustrating a spot forming operation of the line head 4Y. An electrostatic latent image is formed by the formation of spots. The spot forming operation of the line head according to this embodiment will described with reference to FIGS. 12 and 13. In order to facilitate the understanding of the invention, the case in which a plurality of spots is aligned on a straight line extending in the main scanning direction XX is described. In this embodiment, a plurality of spots are formed side by side on the straight line extending in the main scanning direction XX by driving a plurality of light-emitting elements 411 to emit light at predetermined timings while transporting the surface 200 of the photoconductor 2Y in the sub-scanning direction YY.

In FIG. 12, in the line head 4Y according to this embodiment, six light-emitting element rows L411 are arranged in the sub-scanning direction YY so as to correspond to sub-scanning direction positions Y1 to Y6. The light-emitting element rows L411 located at the same position in the sub-scanning direction YY emit light substantially at the same timing, and the light-emitting element rows L411 located at different positions in the sub-scanning direction YY emit light at different timings. Specifically, the light-emitting element rows L411 emit light in the order of the sub-scanning direction positions Y1 to Y6. A plurality of spots are formed side by side on a straight line extending in the main scanning direction XX of the surface 200 by driving the light-emitting element rows L411 to emit light in the above-mentioned order while transporting the surface 200 of the photoconductor 2Y in the sub-scanning direction YY.

The above-mentioned operation will be described with reference to FIGS. 12 and 13. First, the light-emitting elements 411 in the light-emitting element rows L411 disposed at the sub-scanning direction position Y1 belonging to the light-emitting element groups 410A1, 410A2, 410A3, . . . arranged on the uppermost side in the sub-scanning direction YY are driven to emit light. A plurality of light components emitted by the light-emitting operation are focused on the surface 200 of the photoconductor 2Y by the lenses L, which are 'focusing lenses' having the above-mentioned inverting and enlarging properties, while being inverted and enlarged. That is, spots are formed at 'first' hatched pattern positions shown in FIG. 13.

In FIG. 13, white circles indicate spots that are not formed yet, but will be formed later. In FIG. 13, spots labeled by reference numerals 410C1, 410B1, 410A1, and 410C2 are formed by the light-emitting element groups 410 corresponding to the reference numerals.

Then, the light-emitting elements 411 in the light-emitting element rows L411 disposed at the sub-scanning direction position Y2 belonging to the light-emitting element groups 410A1, 410A2, 410A3, . . . are driven to emit light. A plurality of light components emitted by the light-emitting operation is focused on the surface 200 of the photoconductor 2Y by the lenses L while being inverted and enlarged. That is, in FIG. 13, spots are formed at 'second' hatched pattern positions. Here, when the surface 200 of the photoconductor 2Y is transported in the sub-scanning direction YY, the light-emitting element rows L411 are sequentially driven to emit light from the downstream side in the sub-scanning direction YY (that is, in the order of the sub-scanning direction positions Y1 and Y2). This is because the lens L has inversion characteristics.

Then, the light-emitting elements 411 in the light-emitting element rows L411 disposed at the sub-scanning direction position Y3 belonging to the second light-emitting element groups 410B1, 410B2, 410B3, . . . from the upstream side in the sub-scanning direction YY are driven to emit light. A plurality of light components emitted by the light-emitting operation is focused on the surface 200 of the photoconductor 2Y by the lenses L while being inverted and enlarged. That is, spots are formed at 'third' hatched pattern positions shown in FIG. 13.

Then, the light-emitting elements 411 in the light-emitting element rows L411 disposed at the sub-scanning direction position Y4 belonging to the light-emitting element groups 410B1, 410B2, 410B3, . . . are driven to emit light. A plurality of light components emitted by the light-emitting operation is focused on the surface 200 of the photoconductor 2Y by the lenses L while being inverted and enlarged. That is, spots are formed at 'fourth' hatched pattern positions shown in FIG. 13.

Then, the light-emitting elements 411 in the light-emitting element rows L411 disposed at the sub-scanning direction position Y5 belonging to the light-emitting element groups 410C1, 410C2, 410C3, . . . on the lowermost side in the sub-scanning direction YY are driven to emit light. A plurality of light components emitted by the light-emitting operation is focused on the surface 200 of the photoconductor 2Y by the lenses L while being inverted and enlarged. That is, spots are formed at 'fifth' hatched pattern positions shown in FIG. 13.

Finally, the light-emitting elements 411 in the light-emitting element rows L411 disposed at the sub-scanning direction position Y6 belonging to the light-emitting element groups 410C1, 410C2, 410C3, . . . are driven to emit light. A plurality of light components emitted by the light-emitting operation is focused on the surface 200 of the photoconductor 2Y by the lenses L while being inverted and enlarged. That is, spots are formed at 'sixth' hatched pattern positions shown in FIG. 13. In this way, the first to sixth light-emitting operations are performed to form a plurality of spots on the straight line extending in the main scanning direction XX.

This embodiment has the following effects.

(5) It is possible to obtain the above-mentioned effects even in the line head 4Y and the image forming apparatus 1 in which the light-emitting element groups 410 and the lenses L are two-dimensionally arranged.

Third Embodiment

Figure 14:
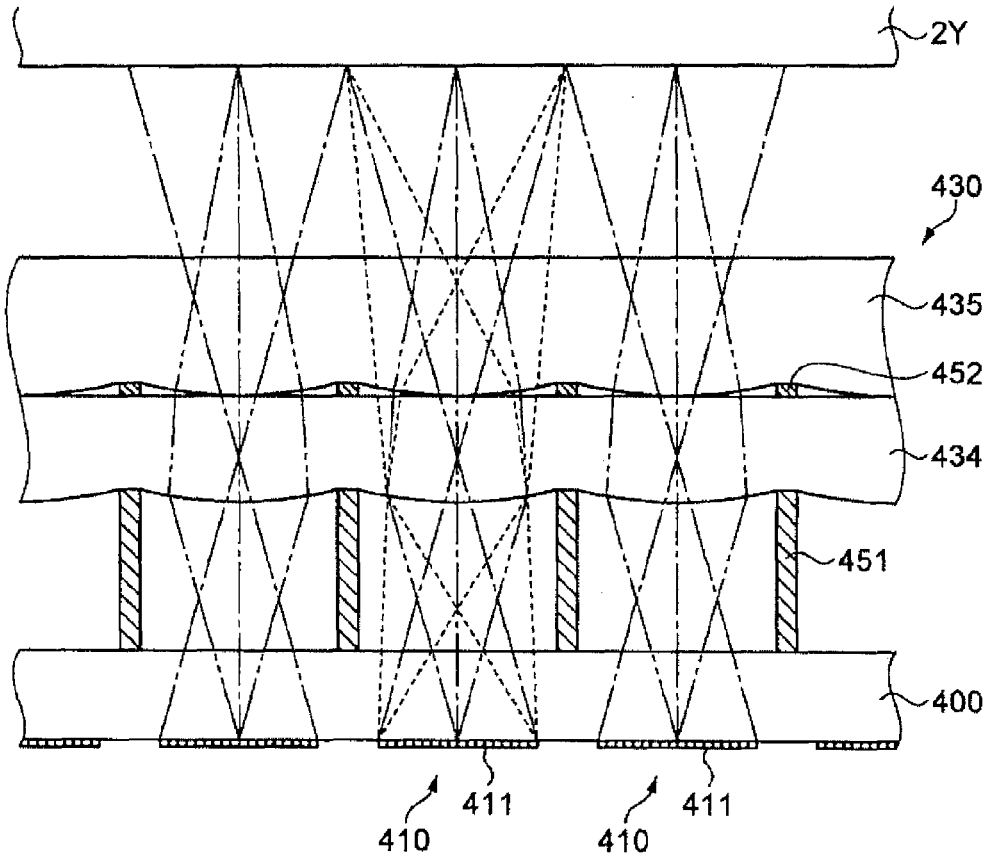
FIG. 14 is an enlarged view illustrating the vicinities of a head substrate, a lens array, and a photoconductor according to a third embodiment of the invention.

FIG. 14 is an enlarged view illustrating the vicinities of a head substrate 400, a lens array 430, and a photoconductor 2Y according to a third embodiment of the invention. The structure of this embodiment is similar to that of the first embodiment except for the lens array 430. In this embodiment, the same components and members as those in the first embodiment are denoted by the same reference numerals. In this embodiment, the light-emitting element groups 410 are one-dimensionally arranged.

Figure 15:
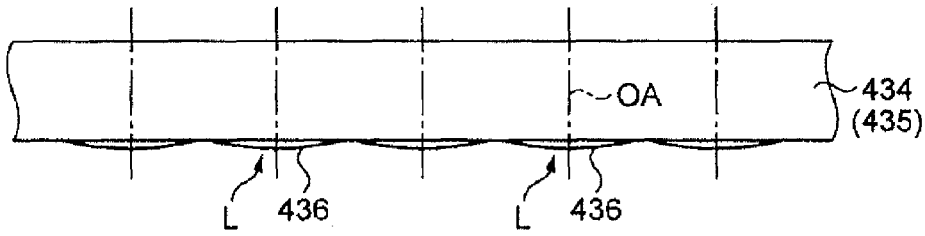
FIG. 15 is a cross-sectional view illustrating the lens substrate.

In FIG. 14, the lens array 430 includes two lens substrates 434 and 435. Light-shielding members 451 and 452 are provided between the head substrate 400 and the lens array 430 and between the two lens substrates 434 and 435. FIG. 15 is a cross-sectional view illustrating the lens substrates 434 and 435. Lenses 436 are formed of resin on one surface of each of the lens substrates 434 and 435.

This embodiment has the following effect in addition to the effects of the above-described embodiments. (6) It is possible to obtain the above-mentioned effects even in the line head 4Y and the image forming apparatus 1 including the two lens substrates 434 and 435.

Fourth Embodiment

Figure 16:
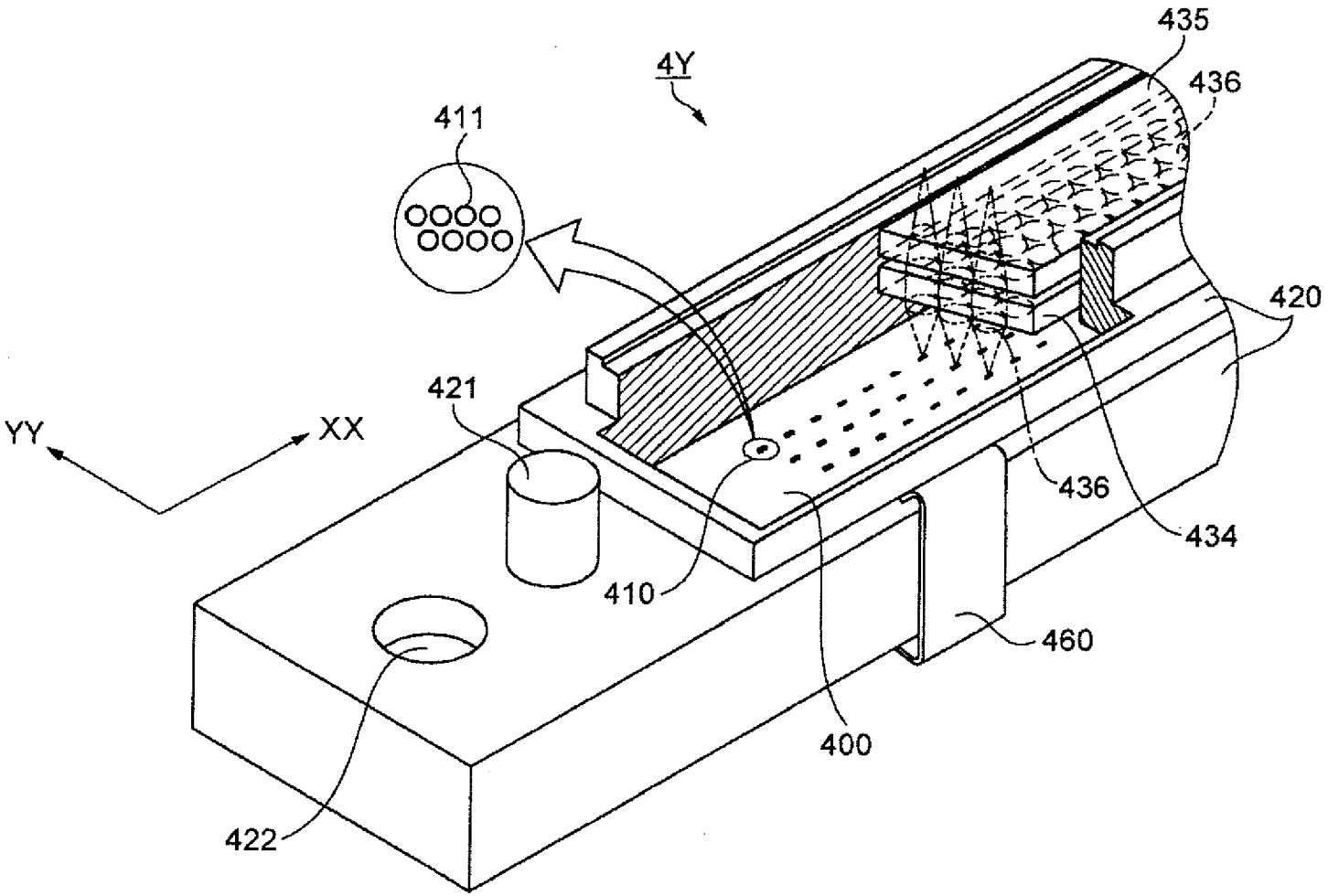
FIG. 16 is a perspective view schematically illustrating a line head according to a fourth embodiment of the invention.
Figure 17:
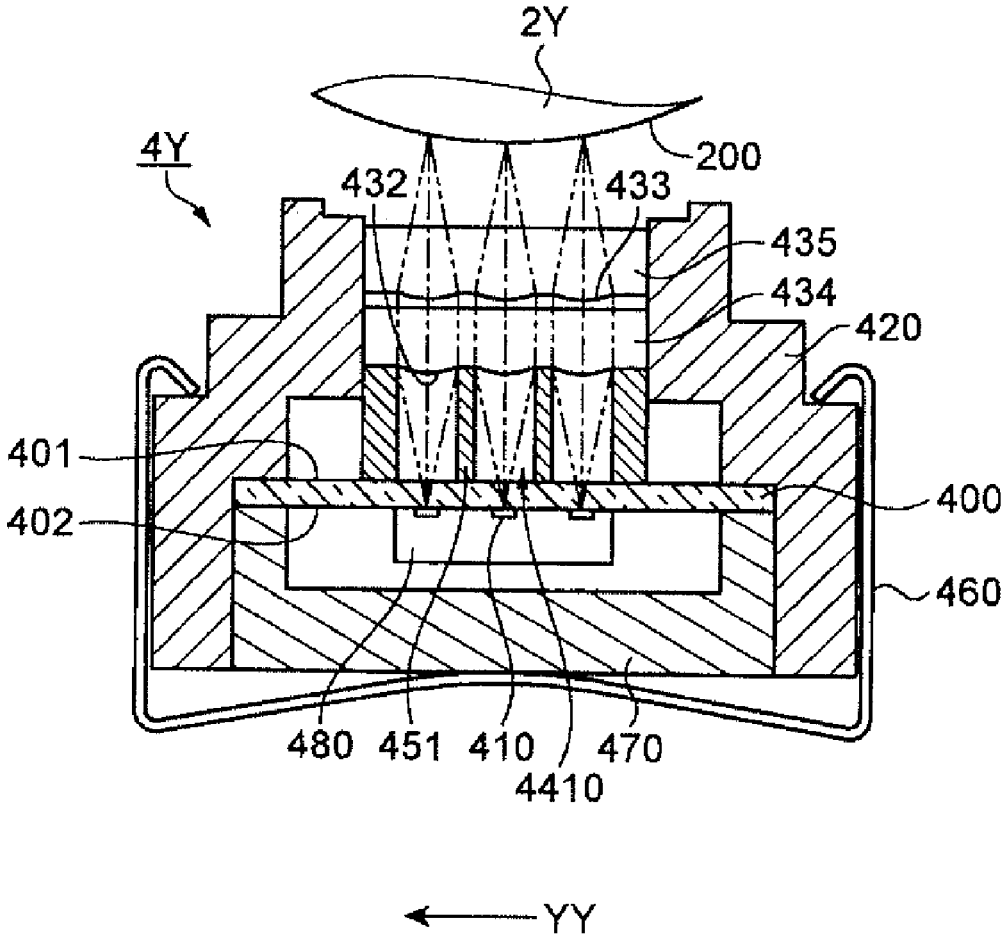
FIG. 17 is a cross-sectional view illustrating the sub-scanning direction YY of the line head.

FIG. 16 is a perspective view schematically illustrating a line head 4Y according to a fourth embodiment of the invention. FIG. 17 is a cross-sectional view illustrating the sub-scanning direction YY of the line head 4Y. In this embodiment, members having the same functions as those in the second embodiment are denoted by the same reference numerals. In this embodiment, light-emitting element groups and the lenses formed on the lens substrate according to the third embodiment are two-dimensionally arranged.

This embodiment has the following effect in addition to the effects of the above-described embodiments. (7) It is possible to obtain the above-mentioned effects even in the line head 4Y and the image forming apparatus 1 including the two lens substrates 434 and 435, and the light-emitting element groups 410 and the lenses L two-dimensionally arranged therein.

Fifth Embodiment

Figure 18:
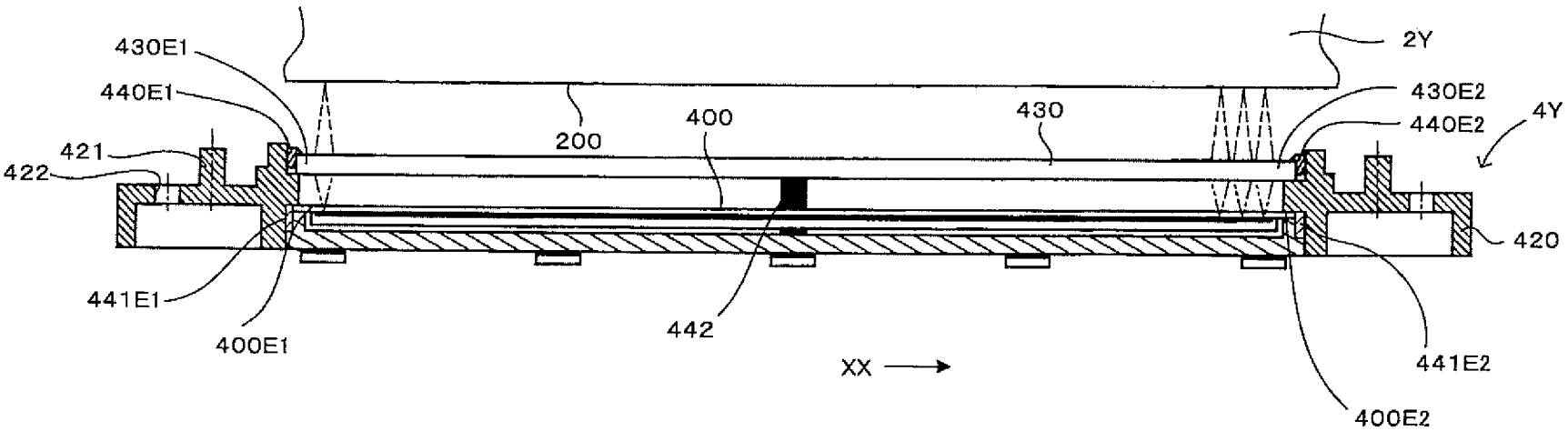
FIG. 18 is a diagram illustrating a line head according to a fifth embodiment of the invention.

FIG. 18 is a perspective view schematically illustrating a line head 4Y according to a fifth embodiment of the invention. The fifth embodiment differs from the first embodiment in that the fixing positions of the head substrate 400 and the lens array 430 to the case 420. That is, in the fifth embodiment, a supporting member 442 is fixed to the center of the lower surface of the case 420 in the main scanning direction (first direction) XX. The supporting member 442 protrudes from the case 420 to the photoconductor 2Y, and the center of the head substrate 400 and the center of the lens array 430 are fixedly supported by the supporting member 442.

Both ends 430E1 and 430E2 of the lens array 430 in the main scanning direction XX are supported by the case 420 with elastic members 440E1 and 440E2 interposed therebetween such that the lens array can be moved in the main scanning direction XX relative to the case 420. Therefore, when the ambient temperature of the line head 4Y is increased, the lens array 430 is expanded. However, since the center of the lens array in the main scanning direction XX is fixed, the two ends 430E1 and 430E2 are thermally expanded in the main scanning direction XX against the elastic forces of the elastic members 440E1 and 440E2.

The head substrate 400 has the same structure as the lens array 430. That is, both ends 400E1 and 400E2 of the head substrate 400 in the main scanning direction (first direction) XX are supported by the case 420 with elastic members 441E1 and 441E2 interposed therebetween such that they can be moved in the main scanning direction XX relative to the case 420. Therefore, when the ambient temperature of the line head 4Y is increased, the head substrate 400 is expanded. However, since the center of the head substrate in the main scanning direction XX is fixed, the two ends 400E1 and 400E2 are thermally expanded in the main scanning direction XX against the elastic forces of the elastic members 441E1 and 441E2. The other structures are the same as those in the first embodiment.

This embodiment has the following effects in addition to the effects of the above-described embodiments. That is, since the center of the head substrate 400 and the center of the lens array 430 in the main scanning direction XX are fixed, the distance from the fixing portion to the outermost light-emitting element 411 is about half that in the first embodiment. Therefore, the movement of the focal position due to thermal expansion is about half that in the first embodiment.

Sixth Embodiment

Figure 19:
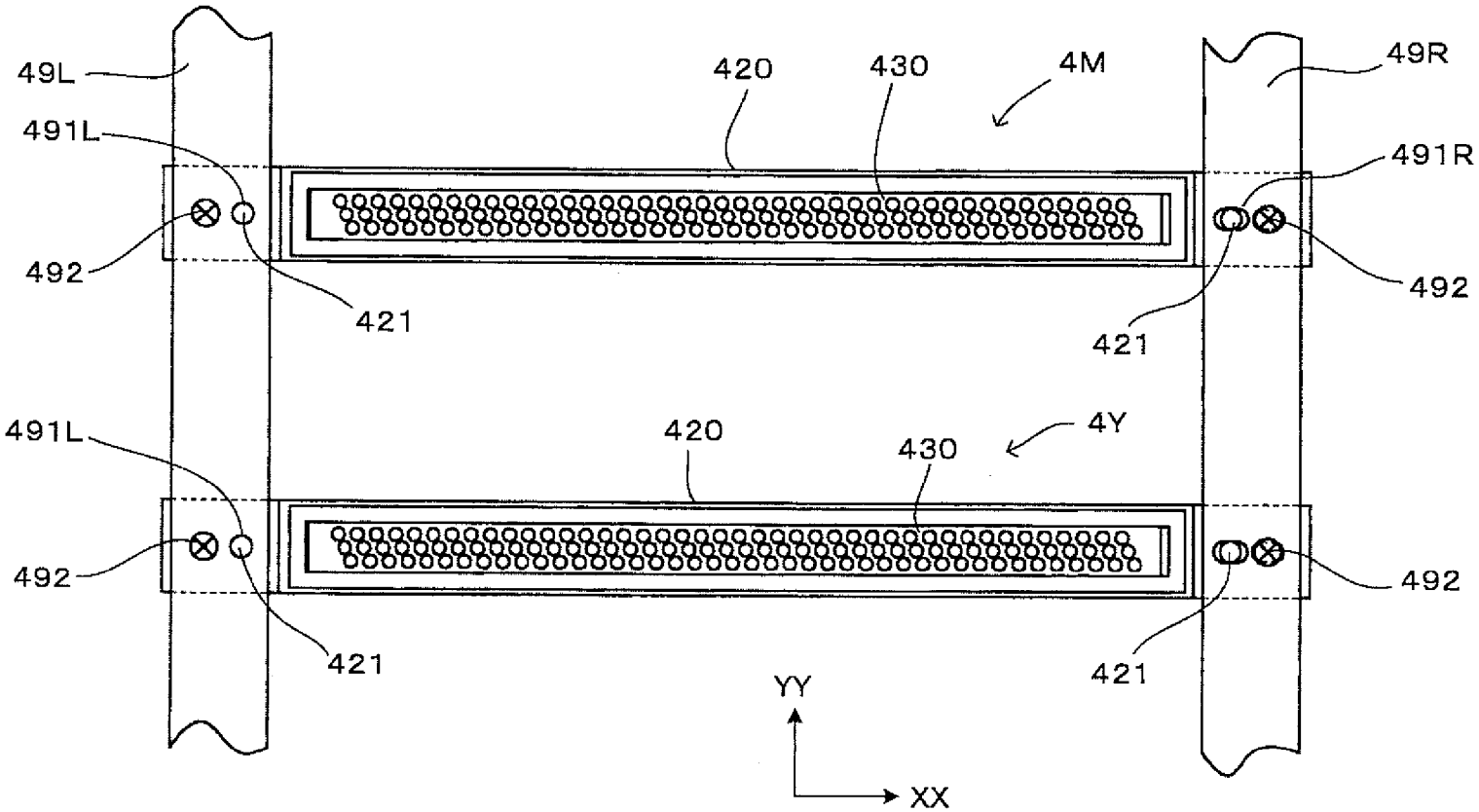
FIG. 19 is a diagram illustrating a line head according to a sixth embodiment of the invention.

FIG. 19 is a perspective view schematically illustrating a line head 4Y according to a sixth embodiment of the invention. In the sixth embodiment, yellow, magenta, cyan, and black line heads 4Y, 4M, 4C, and 4K are attached to a head fixing member 49 that is fixed to an apparatus body. FIG. 19 shows two line heads 4Y and 4M, and the sixth embodiment will be described below with reference to FIG. 19.

In the sixth embodiment, two head fixing members 49L and 49R are arranged in parallel with a predetermined gap therebetween in the sub-scanning direction YY, and the line heads 4Y and 4M are arranged so as be laid across the two head fixing members 49L and 49R. Positioning pins 421 and screw insertion holes (see FIG. 9) are provided at both ends of the case 420 of each of the line heads 4Y and 4M. The positioning pins 421 are fitted into positioning holes 491L and 491R respectively formed in the head fixing members 49L and 49R to position the line heads 4Y and 4M relative to the photoconductors 2Y and 2M, and the line heads 4Y and 4M are fixed to the fixing members 49L and 49R by fixing screws 492. In this embodiment, the positioning pins 421 are inserted into the positioning holes 491L formed in one (left in FIG. 19) head fixing member 49L to position the line heads 4Y and 4M in both the main scanning direction XX and the sub-scanning direction YY.

In contrast, the positioning holes 491R formed in the other (right in FIG. 19) head fixing member 49R have an elongated shape that extends in the main scanning direction XX, and the positioning pins 421 are inserted into the positioning holes 491R to position the line heads 4Y and 4M in the sub-scanning direction YY. However, the other ends of the line heads 4Y and 4M can be moved in the main scanning direction XX. In the head fixing member 49R, through holes 493R into which the fixing screws 492 are inserted are also elongated. As such, one end of each of the line heads 4Y and 4M is fixed to the head fixing member 49L, and the other ends of the line heads 4Y and 4M are supported by the head fixing member 49R such that the line heads can be moved in the main scanning direction XX, but the movement of the line heads in the sub-scanning direction YY is regulated.

As such, the line heads 4Y and 4M are positioned and fixed to the head fixing member 49L, and are expanded in the main scanning direction XX when the ambient temperature of the line heads 4Y and 4M is increased and the case 420 is thermally expanded.

The line heads 4Y and 4M fixed to the head fixing members 49L and 49R have the same structure as that in the above-described embodiment. That is, one end (left end in FIG. 19) of each of the head substrate 400 and the lens array 430 in the main scanning direction (first direction) XX is fixed to form a fixing portion, and the other ends (right ends in FIG. 19) are supported by the case 420 with elastic members interposed therebetween such that the head substrate and the lens array can be moved in the main scanning direction XX. Therefore, when the ambient temperature of the line heads 4Y and 4M is increased, the head substrate 400 and the lens array 430 are thermally expanded from the fixing portions to the other ends in the main scanning direction (first direction) XX.

As described above, in the sixth embodiment, one end of each of the case 420, the head substrate 400, and the lens array 430 in the main scanning direction (first direction) XX is fixed, and the case 420, the head substrate 400, and the lens array 430 can be expanded to the other ends thereof. Therefore, the movement direction of the focal position due to thermal expansion is constant for each color component. In addition, the line heads 4Y and 4M having the above-mentioned operations and effects are used. Therefore, it is possible to effectively prevent the deviation of the focal position between color components, that is, a color registration error. As a result, it is possible to form a high-quality color image.

Others

The invention is not limited to the above-described embodiments and Examples, but various modifications and changes of the invention can be made without departing from the spirit and scope of the invention.

In the second and third embodiments, the light-emitting element groups 410 are two-dimensionally arranged such that three light-emitting element group rows L410 (group rows), each including a predetermined number (two or more) of light-emitting element rows L411 arranged in the main scanning direction XX, are arranged in the sub-scanning direction YY. However, the arrangement of a plurality of light-emitting element groups 410 is not limited thereto, but it may be appropriately changed.

Further, in the above-described embodiments, the line head is used to form a plurality of spots in a straight line in the main scanning direction XX, as shown in FIG. 13. However, the spot forming operation is just an example of the operation of the line head, but the operation of the line head is not limited thereto. That is, spots may be formed in any pattern other than a straight pattern in the main scanning direction XX. For example, spots may be formed at a predetermined angle in the main scanning direction XX, or they may be formed in a zigzag or a wavy shape.

The above-described embodiments and modifications are applied to a color image forming apparatus, but the invention is not limited thereto. For example, the invention may be applied to a monochrome image forming apparatus that forms a so-called monochrome image.

Further, the invention can be applied to an image forming apparatus using dry toner as well as the image forming apparatus using the liquid toner having toner particles dispersed in a non-volatile liquid carrier.

What is claimed is:

1. A line head comprising:

a first substrate that includes light-emitting elements formed thereon; and a second substrate that includes focusing lenses, which are inverted optical systems, focusing light emitted from the light-emitting elements, and has a linear expansion coefficient that is smaller than that of the first substrate, wherein the linear expansion coefficient $\alpha L$ of the second substrate and the linear expansion coefficient $\alpha E$ of the first substrate satisfy the following expression:

$\alpha L+m(\alpha E-\alpha L)=0$ (where m indicates the optical magnification of the focusing lens).

2. The line head according to claim 1, wherein the first substrate and the second substrate are fixed so as to be expanded or contracted in a first direction that is orthogonal to a optical axis direction of the focusing lens according to temperature.

3. The line head according to claim 2, wherein the first substrate and the second substrate are arranged such that one end of the first substrate in the first direction and one end of the second substrate in the first direction are fixed and the other ends of the first and second substrates in the first direction are expanded or contracted in the first direction according to the temperature.

4. The line head according to claim 3, further comprising:

a case that accommodates the first substrate and the second substrate, wherein the first substrate and the second substrate are fixed to the case, and the other end of the first substrate and the other end of the second substrate are supported by the case so as to be movable in the first direction.

5. The line head according to claim 4, wherein the other end of the first substrate and the other end of the second substrate are supported by the case with elastic members interposed therebetween.

6. The line head according to claim 2, wherein the first substrate and the second substrate are arranged such that a center of the first substrate in the first direction and the center of the second substrate in the first direction are fixed and both ends of the first substrate in the first direction and both ends of the second substrate in the first direction are expanded or contracted in the first direction according to a temperature.

7. The line head according to claim 1, wherein a light-emitting element group including a plurality of light-emitting elements is formed on the first substrate, and the focusing lenses focus light emitted from the plurality of light-emitting elements of the light-emitting element group.

8. The line head according to claim 7, wherein a plurality of light-emitting element groups are arranged on the first substrate.

9. The line head according to claim 8, wherein the plurality of light-emitting element groups are two-dimensionally arranged on the first substrate.

10. An image forming apparatus comprising:

a latent image carrier on which a latent image is formed;

an exposure unit that includes the line head according to claim 1, and forms the latent image on the latent image carrier; and a developing unit that develops the latent image formed on the latent image carrier.

* * * * *